US011426324B2

(12) United States Patent
Zhijian

(10) Patent No.: US 11,426,324 B2
(45) Date of Patent: Aug. 30, 2022

(54) LOAD-REDUCING MASSAGE BACKPACK

(71) Applicant: Li Zhijian, Fujian (CN)

(72) Inventor: Li Zhijian, Fujian (CN)

( * ) Notice: Subject to any disclaimer, the term of this patent is extended or adjusted under 35 U.S.C. 154(b) by 299 days.

(21) Appl. No.: 16/693,259

(22) Filed: Nov. 23, 2019

(65) Prior Publication Data

US 2020/0222274 A1 Jul. 16, 2020

Related U.S. Application Data

(60) Provisional application No. 62/834,551, filed on Apr. 16, 2019.

(30) Foreign Application Priority Data

Jan. 11, 2019 (CN) ..... 201910028229.9

(51) Int. Cl.
*A61H 23/02* (2006.01)
*A45F 3/04* (2006.01)
*A45F 3/00* (2006.01)

(52) U.S. Cl.
CPC ..... *A61H 23/02* (2013.01); *A45F 3/04* (2013.01); *A45F 2003/003* (2013.01); *A45F 2003/045* (2013.01); *A61H 2201/1207* (2013.01); *A61H 2201/165* (2013.01); *A61H 2201/1626* (2013.01); *A61H 2201/5007* (2013.01); *A61H 2201/5043* (2013.01); *A61H 2205/081* (2013.01)

(58) Field of Classification Search
CPC ..... A61H 23/02
USPC ..... 224/576
See application file for complete search history.

(56) References Cited

U.S. PATENT DOCUMENTS

| | | | | |
|---|---|---|---|---|
| 3,957,184 | A | 5/1976 | Shurman | |
| 6,816,760 | B1 | 11/2004 | Namaky | |
| 6,870,089 | B1 | 3/2005 | Gray | |
| 9,144,255 | B1 | 9/2015 | Perciballi | |
| 10,561,225 | B2 * | 2/2020 | Parekh | A45F 3/047 |
| 10,616,534 | B2 | 4/2020 | Thiel | |

(Continued)

FOREIGN PATENT DOCUMENTS

KR 2014132850 A 11/2014

*Primary Examiner* — Nathan J Newhouse
*Assistant Examiner* — Lester L Vanterpool
(74) *Attorney, Agent, or Firm* — Jennifer Meredith; Meredith Attorneys, PLLC

(57) ABSTRACT

A load-reducing massage backpack comprising the pack body and the back belt. An interlayer with an upper opening is arranged on the pack body against the back, an elastic fixed laminate is provided in the interlayer, the lower end of the fixed laminate is provided at the bottom of the interlayer and the upper end can extend out of the opening and is connected to the back belt, and the back of the pack body is against the waist and the massage apparatus. The present invention overcomes the defects existing in the prior backpack without massage function and in the prior massagers which only massage the waist, shoulder or back alone but cannot massage these positions simultaneously. An elastic fixed laminate is arranged on the backpack and a massage apparatus is disposed on the fixed laminate to massage the waist, shoulder and back. The massage apparatus is easy, flexible and can massage one or more positions simultaneously, support change of the massage position based on the user's demand, and be removed and used separately.

8 Claims, 27 Drawing Sheets

(56) References Cited

U.S. PATENT DOCUMENTS

| | | | | |
|---|---|---|---|---|
| 2002/0198031 | A1 | 12/2002 | Holmes | |
| 2003/0062391 | A1* | 4/2003 | Mitchell | A45F 3/04 224/576 |
| 2003/0168488 | A1* | 9/2003 | Ho | A45F 3/04 224/629 |
| 2005/0020184 | A1 | 1/2005 | Izcoa | |
| 2005/0140331 | A1 | 6/2005 | McQuade | |
| 2006/0113343 | A1* | 6/2006 | Chang | A45F 3/12 224/645 |
| 2007/0297149 | A1 | 12/2007 | Richardson | |
| 2008/0011799 | A1 | 1/2008 | Chang | |
| 2008/0125164 | A1 | 5/2008 | Singh | |
| 2008/0210728 | A1 | 9/2008 | Bihn | |
| 2009/0061926 | A1 | 3/2009 | Lee | |
| 2009/0201671 | A1 | 8/2009 | Huntley | |
| 2009/0224722 | A1 | 9/2009 | Causey | |
| 2009/0276089 | A1 | 11/2009 | Bartholomew | |
| 2011/0110514 | A1 | 5/2011 | Gustavsson | |
| 2012/0262117 | A1 | 10/2012 | Ferber | |
| 2012/0299528 | A1 | 11/2012 | Scarmozzino | |
| 2013/0026726 | A1 | 1/2013 | Thomas | |
| 2013/0162389 | A1 | 6/2013 | Crucs | |
| 2013/0214931 | A1 | 8/2013 | Chia | |
| 2013/0249673 | A1 | 9/2013 | Ferrari | |
| 2014/0002239 | A1 | 1/2014 | Rayner | |
| 2014/0061273 | A1 | 3/2014 | Bullivant | |
| 2014/0171132 | A1 | 6/2014 | Ziemianska | |
| 2015/0296644 | A1 | 10/2015 | Chin | |
| 2015/0326044 | A1 | 11/2015 | Ashley | |
| 2015/0359127 | A1 | 12/2015 | Daoura | |
| 2015/0366333 | A1 | 12/2015 | Zhijian | |
| 2016/0112004 | A1 | 4/2016 | Thiel | |
| 2016/0118634 | A1 | 4/2016 | Thiel | |
| 2016/0141904 | A1 | 5/2016 | Zhijian | |
| 2017/0027806 | A1* | 2/2017 | Lin | A45F 4/02 |
| 2017/0196347 | A1 | 7/2017 | Sawhney | |
| 2019/0343266 | A1 | 11/2019 | Parekh | |
| 2019/0374012 | A1 | 12/2019 | Chang | |

* cited by examiner

LOAD-REDUCING MASSAGE BACKPACK

TECHNICAL FIELD

The present invention relates to a load-reducing massage backpack in the luggage production field.

BACKGROUND OF THE UTILITY MODEL

Prior backpacks are mostly of a single function without massage function. Under load for a long term, the user will inevitably suffer from backache which can only be mitigated with a separate massager. Additionally, the commercially-available massager can only massage the waist, shoulder or back alone but cannot massage these positions simultaneously. Therefore, it's highly urgent to provide a load-reducing massage backpack that can massage the waist, shoulder and back simultaneously and can support change of the massage position based on the user's demand.

SUMMARY OF THE INVENTION

To overcome the defects existing in the prior backpack without massage function and in the prior commercially-available massager which can only massage the waist, shoulder or back alone but cannot massage these positions simultaneously, the present invention provides a load-reducing massage backpack, wherein an elastic fixed laminate is arranged on the backpack and an massage apparatus is arranged on the fixed laminate to massage the waist, shoulder and back. The massage apparatus which is easy and flexible for use can massage one or more positions simultaneously, can support change of the massage position based on the user's demand, and even can be removed and used separately.

Technical scheme of the invention is as follows: A load-reducing massage backpack comprises the pack body and the back belt, wherein an interlayer with an upper opening is arranged on the pack body against the back, an elastic fixed laminate is provided in the interlayer, the lower end of the fixed laminate is provided at the bottom of the interlayer and the upper end can extend out of the opening and is connected to the back belt, and a massage apparatus is arranged at one or more positions where the back of the pack body is against the waist, the fixed laminate is against the back or the back belt is against the shoulder.

The load-reducing massage backpack, wherein an elastic fixed laminate is arranged in the interlayer and a massage apparatus is arranged on the fixed laminate to massage the waist, shoulder and back, can massage a plurality of positions simultaneously and can support change of the massage position based on the user's demand.

The top of the fixed laminate is connected via a first limit belt to the top of the pack body so as to fix the fixed laminate and avoid discomfort due to excessive lean-back of the pack body. The fixed laminate includes the upper piece and the lower piece connected in sequence from top to down. The bottom of the lower piece is connected at the bottom of the interlayer. The upper piece is exposed beyond the opening of the interlayer. The lower piece is made of elastic material. The back belt is connected via the upper piece to the fixed laminate. The lower piece can be made of a piece of wide elastic cloth or a plurality of elastic ribbons. As the upper piece can move up and down, it is convenient to adjust the position of the massage apparatus. In the present invention, the lower piece is of the elastic design, which can generate elastic waggle similar to a shoulder pole, reduce the load and mitigate the direct impact of the back belt on the shoulder, and improve the comfort level.

The bottom of the upper piece is connected via a second limit belt to the bottom of the interlayer, and the second limit belt is longer than the longitudinal length of the lower piece to limit upward and downward movement of the upper piece. The second limit belt can limit upward and downward movement of the upper piece to avoid fracture of the lower piece under excessive load. The first limit belt and the second limit belt can be ribbon or elastic ribbon.

The massage apparatus comprises at least one massage mechanism and a control circuit used to control the massage mechanism. The control circuit is also equipped with the power cable used to supply power for the control circuit and the massage mechanism. The user can connect the power cable to the self-equipped portable power supply to supply power for the control circuit and massage mechanism.

The massage apparatus as defined in the present invention can also include a first power supply. Both the control circuit and the first power supply are disposed on the pack body, and the first power supply directly feeds the control circuit and the massage mechanism respectively. The first power supply can be a large-capacity battery pack, portable power supply, charger, etc.

The massage mechanism can include a pair of a first massage head. The first massage head is fixed at the top left and right of the fixed laminate corresponding to both sides of the back. The massage mechanism of the structure can massage the back.

The massage mechanism can also include a pair of a second massage head. The second massage head is fixed at the bottom left and right of the back of pack body corresponding to both sides of the waist. The massage mechanism of the structure can massage the waist.

The massage mechanism can also include a pair of a third massage head. The third massage head is fixed at one end of the back belt close to the fixed laminate corresponding to the shoulder when the back belt is used. The massage mechanism of the structure can massage the shoulder.

The massage mechanism can also use one or more of the first massage head, second massage head and third massage head based on the user's demand.

The control circuit comprises a control panel and a control circuit board used to receive the instructions from the control panel and control operation of the massage mechanism according to the instructions. The control circuit board is disposed in the pack body. The control panel mounted at any position of the pack body or back belt is connected via power cable to the control circuit board. The cost is lower for the wired control circuit.

The control circuit comprises a wireless remote controller and a control circuit board used to receive the instructions from the wireless remote controller and control operation of the massage mechanism according to the instructions. The control circuit board is disposed in the pack body. The wireless remote controller is connected via radio signal to the control circuit board. The wireless remote control circuit is more convenient to use. The wireless remote controller can be infrared/Bluetooth remote controller or mobile terminal with control software or other short-wave or radio-frequency signal wireless remote controller.

The pack body comprises the backpack and a pair of waist belts connected at the bottom left and right of the pack body corresponding to the waist. Both waist belts can jointly fix the load-reducing massage backpack at the waist. The waist belts can fix the backpack more securely. The control panel can also be disposed on a waist belt which is elastic. The control panel of this preferred scheme is more user-friendly.

The pack body comprises the front pocket body and the back. The front pocket body is integrated via a connector with the back. Both the interlayer and the fixed laminate are disposed on the back. The front pocket body is one of front pocket body structures of different styles and purposes. The preferred scheme facilitates replacement with different front pocket bodies. The connector can be a zipper or buckle.

A first storage pocket is also disposed on the pack body or back belt to place the control panel. The opening of the first storage pocket can be opened or closed with a zipper or buckle. The control panel is connected via power cable in the first storage pocket to the control circuit board in the pack body.

Additionally, the control panel can also be disposed on a waist belt which is made of elastic material and which can be stretched to a position where the user can operate the control panel easily. The control panel can also be directly disposed on the back belt, waist belt, handgrip, or side or bottom of backpack. At these positions (including but not limited to), a first storage pocket can also be disposed for storage purpose.

At the outer side wall of the pack body, a second storage pocket is disposed to place the first power supply. An opening disposed in the second storage pocket can expose the charger switch button to facilitate direct control of the first power supply outside the pack body without opening the backpack.

The load-reducing massage backpack also includes an air inflation layer disposed in the interlayer and located between the inner wall of the interlayer and the fixed laminate. The air inflation layer can press the fixed laminate against the back after inflation. With the scheme, the massage apparatus can fit more closely with the body to achieve the optimum massage effect and reduce the load.

The load-reducing massage backpack also includes a water filling layer disposed in the interlayer and located between the inner wall of the interlayer and the fixed laminate. The water filling layer can press the fixed laminate against the back after being filled with water or conducting coolant. With the scheme, the massage apparatus can fit more closely with the body to achieve the optimum massage effect, reduce the load, and even dissipate the heat.

Furthermore, a heater or a cooler can also be integrated on the load-reducing massage backpack to heat the back in winter or cool the back in summer.

Moreover, the removable massage apparatus disposed at the back of pack body corresponding to the waist or disposed on the fixed laminate corresponding to the back can be mounted on the pack body. The removable massage apparatus comprises a control circuit, a massage mechanism and a second power supply electrically connected to the massage mechanism. The second power supply feeds the massage mechanism and the control circuit and can be dry battery or accumulator. In the preferred scheme, the massage apparatus can be removed and then used separately. For example, the removable massage apparatus can serve as an independent massager to massage the waist or back when the user is traveling by air or by bus and is seated for rest.

Furthermore, the removable massage apparatus also includes an interface that can be connected to the first power supply. When the removable massage apparatus is mounted on the pack body, the first power supply can supply power via the interface to the massage mechanism and the control circuit. Moreover, the second power supply can also be charged through the first power supply. In the scheme design, the second power supply can be kept in active state always so that the removable massage apparatus can be removed at any time and used separately.

A charge interface supporting connection to the portable power supply in the pack body can be disposed on the back belt, and a Bluetooth controller with a charge interface can also be disposed. The control circuit comprises the Bluetooth controller and the control circuit board used to receive the instructions from the Bluetooth controller and control operation of the massage mechanism according to the instructions. The Bluetooth controller can receive Bluetooth signal and communicate with the mobile terminal with control software. The first power supply can also supply power to the Bluetooth controller. In the preferred scheme, the backpack can have more functions, such as Bluetooth anti-lost, charging, connection to Phone APP, by integrating the Bluetooth controller and is thus more user-friendly.

The present invention further discloses another technical scheme that can achieve the purpose of the present invention: Another load-reducing massage backpack comprises the pack body and the back belt, wherein an elastic fixed laminate is arranged at the back of the pack body, the lower end of the fixed laminate is fixed at the back bottom of the pack body and the upper end is fixed and connected to the back belt, the top of the fixed laminate is connected via a third limit belt to the top of the pack body, and a massage apparatus is arranged at one or more positions where the back of the pack body is against the waist, the fixed laminate is against the back or the back belt is against the shoulder. In the preferred scheme, the interlayer structure can be excluded to expose the fixed laminate, facilitate the maintenance, and reduce the cloth and cost.

To increase the decorative aesthetics and comfort of the backpack, the load-reducing massage backpack also includes an isolation layer of which two side edges are connected to two side edges of the back of the pack body. The isolation layer is disposed at part or all of external surface of the fixed laminate and can press the fixed laminate more closely against the back of the pack body. Preferably, the isolation layer can cover the fixed laminate, making the backpack more beautiful and firm. The isolation layer can be made of plus material, EVA composite material or screen cloth material. Other structures are the same as those of the first technical scheme. The purpose of the present invention can also be achieved.

Compared with the prior art, the present invention has the following advantages: 1) The load-reducing massage backpack of the disclosure is characterized in that a fixed laminate is provided in the interlayer of the pack body and a massage apparatus is arranged at one or more positions where the back of the pack body is against the waist, the fixed laminate is against the back or the back belt is against the shoulder to massage a plurality of positions simultaneously. 2) The elastic fixed laminate is so designed that the users can adjust the massage position flexibly based on their own demands.

LABEL DECLARATION

Figure 1:
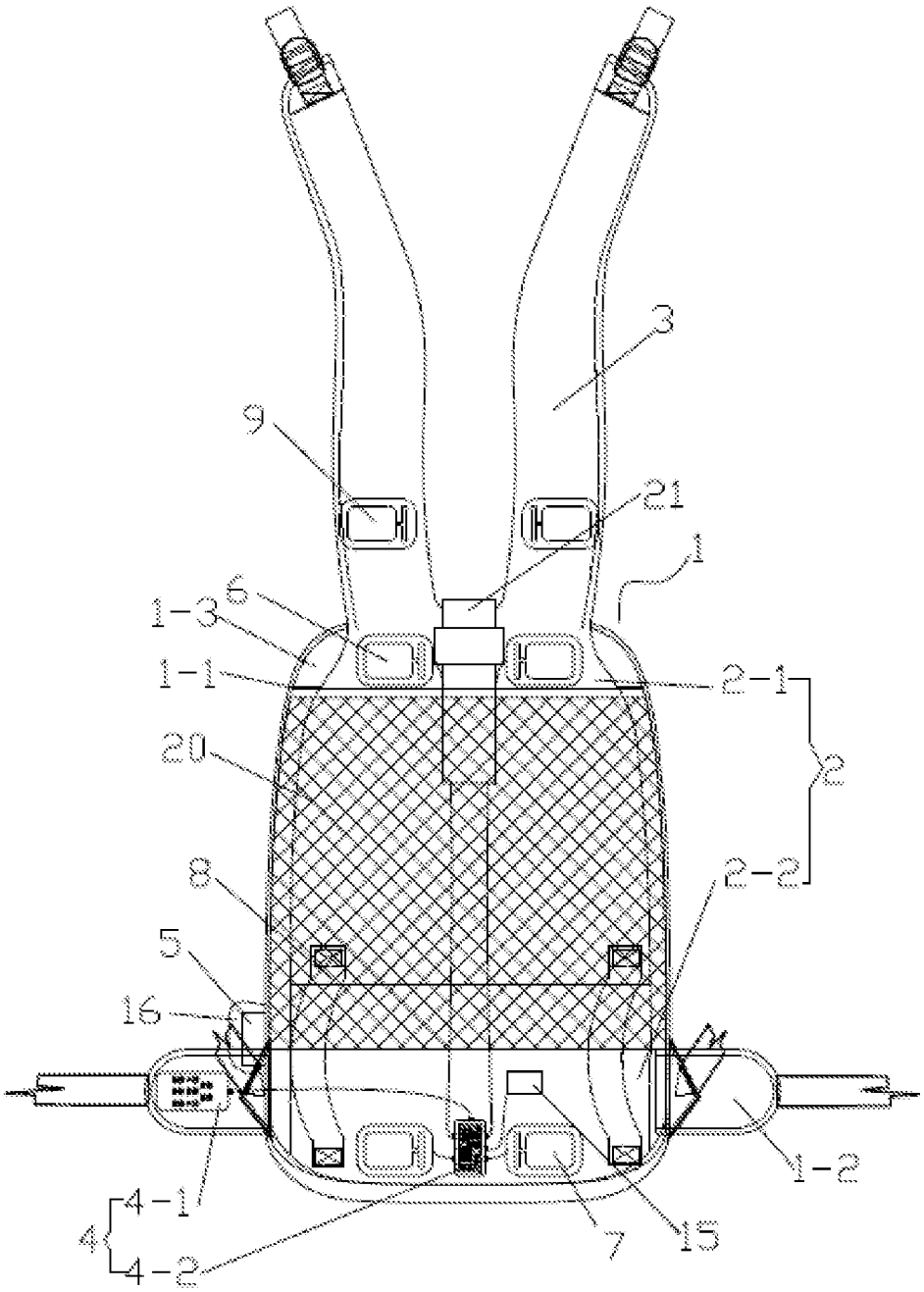
FIG. 1 is a structural view of unlocked back belt for embodiment 1 of load-reducing massage backpack according to the present invention.
Figure 2:
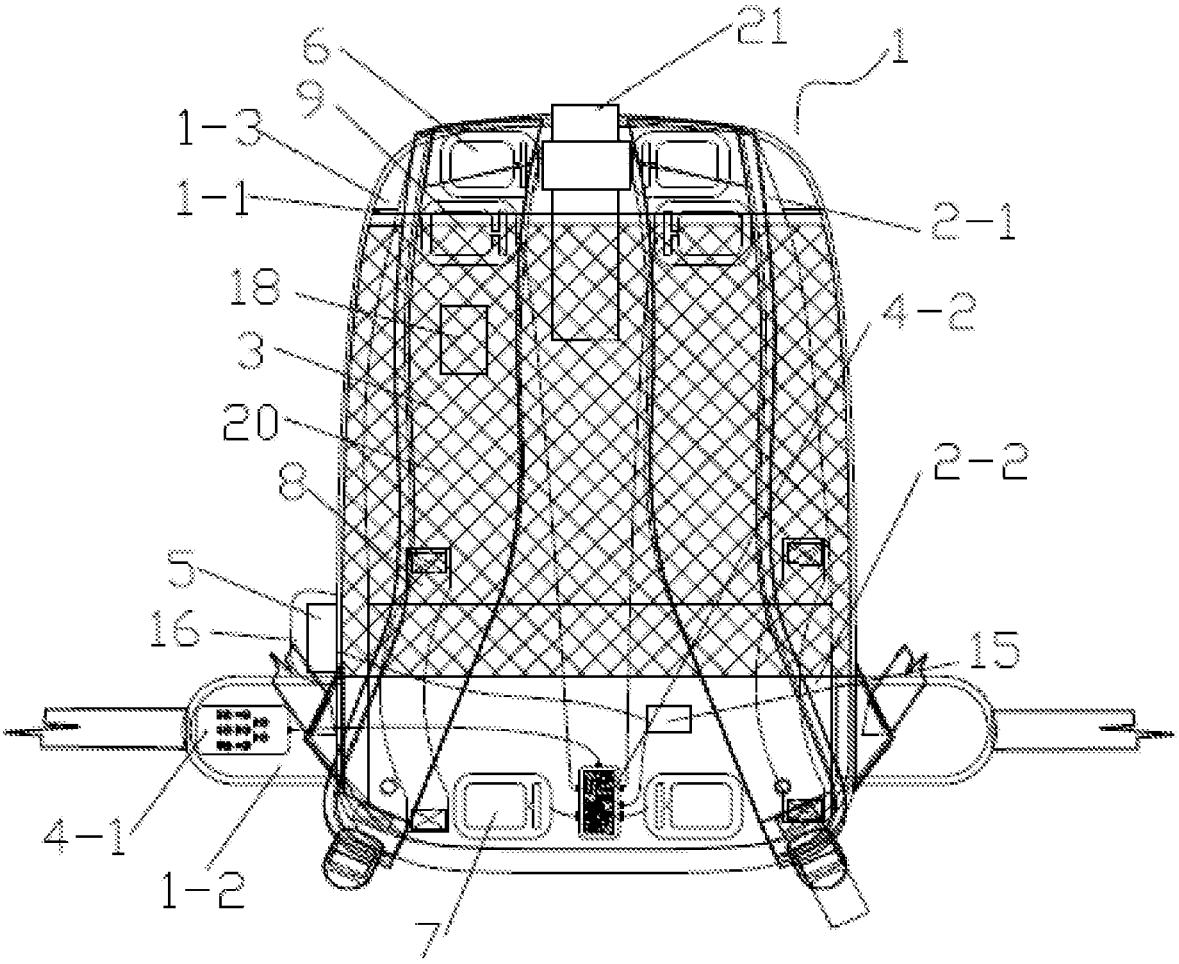
FIG. 2 is a structural view of a usage state for embodiment 1 of load-reducing massage backpack according to the present invention.
Figure 3:
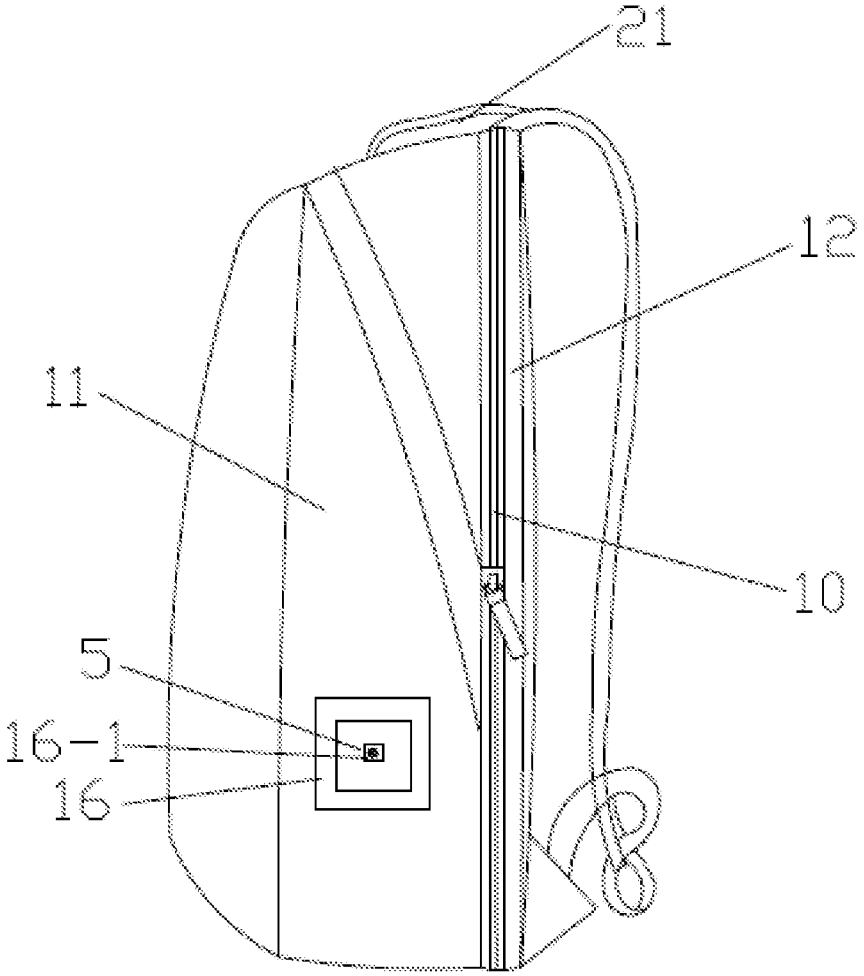
FIG. 3 is a side view for embodiment 1 of load-reducing massage backpack according to the present invention.
Figure 4:
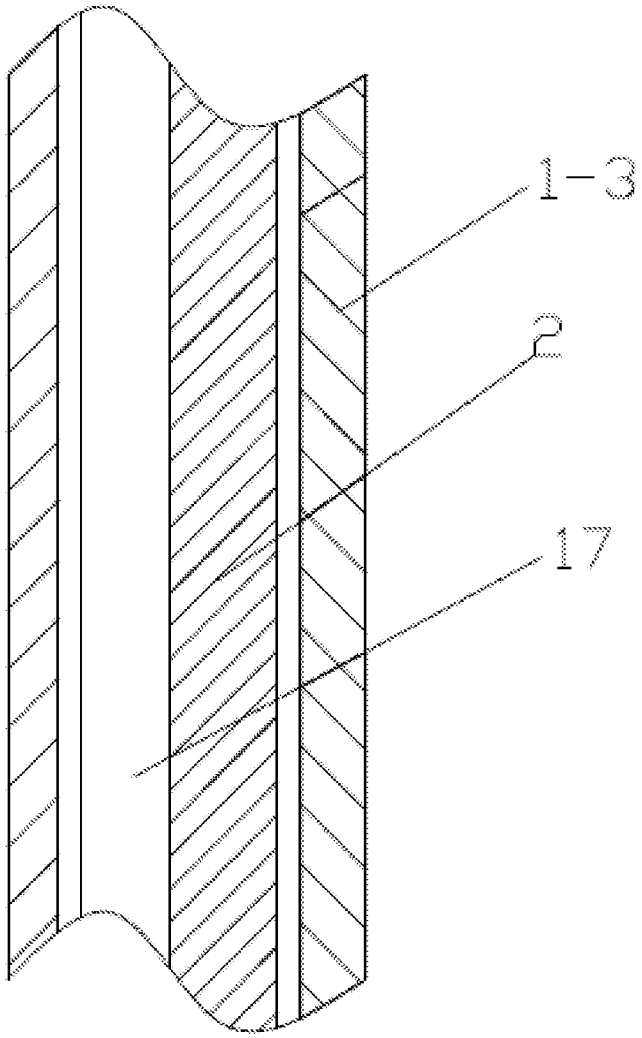
FIG. 4 is a schematic view 1 of an interlayer with air inflation layer of load-reducing massage backpack according to the present invention.
Figure 5:
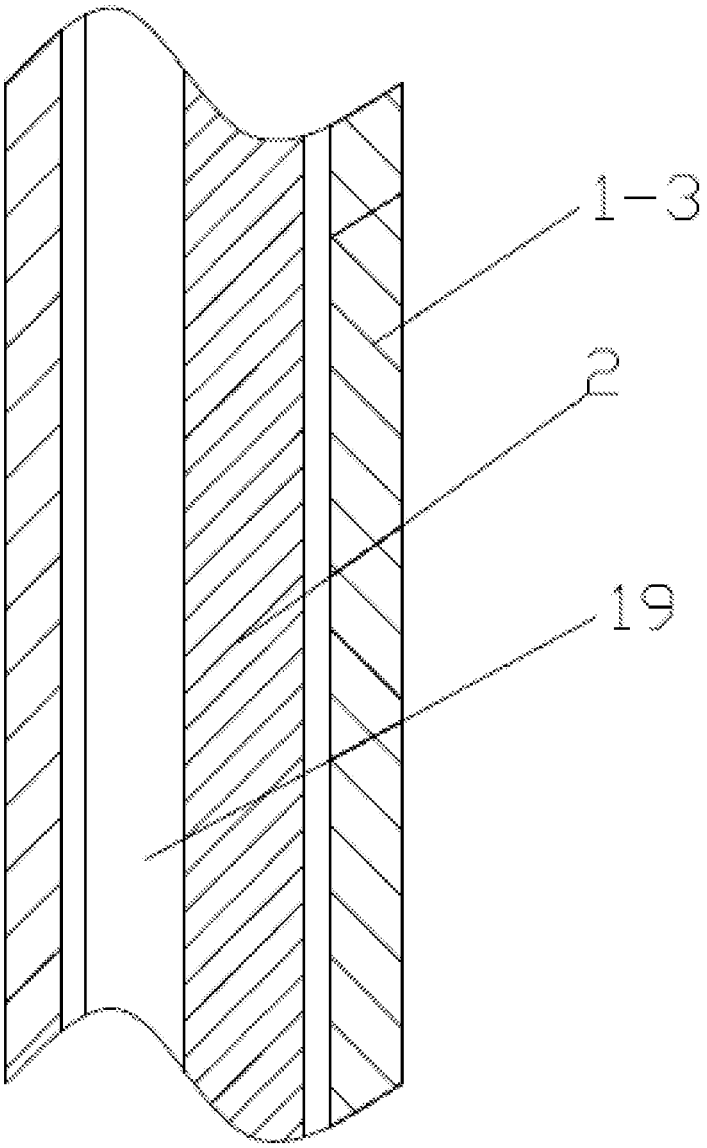
FIG. 5 is a schematic view 1 of an interlayer with water filling layer of load-reducing massage backpack according to the present invention.

Pack Body 1, Fixed Laminate 2, Back Belt 3, Control Circuit 4, First Power Supply 5, First Massage Head 6, Second Massage Head 7, Second Ribbon 8, Third Massage Head 9, Connector 10, Front Pocket Body 11, Back 12, Third Ribbon 13, First Storage Pocket 14, Second Power Supply 15, Second Storage Pocket 16, Air Inflation Layer 17, Bluetooth Controller 18, Water Filling Layer 19, Isolation Layer 20, First Limit Belt 21, Interface 22, Interlayer 1-1, Waist Belt 1-2, Backpack 1-3, Upper Piece 2-1, Lower Piece 2-2, Control Panel 4-1, Control Circuit Board 4-2, Wireless Remote Controller 4-3, Opening 16-1.

DETAILED DESCRIPTION OF THE INVENTION

The technical scheme to the present invention will now be further detailed in combination with the drawings 1-31 of the specifications. Embodiment 1. As shown in FIG. 1-FIG. 5, the present invention relates to a load-reducing massage backpack, comprising the pack body (1) and the back belt (3), characterized in that an interlayer (1-1) with an upper opening is arranged on the pack body (1) against the back, an elastic fixed laminate (2) is provided in the interlayer (1-1), the lower end of the fixed laminate (2) is provided at the bottom of the interlayer (1-1), the upper end can extend out of the opening and is connected to the back belt (3), and a massage apparatus is arranged at one or more positions where the back of the pack body (1) is against the waist, the fixed laminate (2) is against the back or the back belt (3) is against the shoulder.

The top of the fixed laminate (2) is also connected via the first limit belt (21) to the top of the pack body (1). The fixed laminate (2) includes the upper piece (2-1) and the lower piece (2-2) connected in sequence from top to down, the bottom of the lower piece (2-2) is connected at the bottom of the interlayer (1-1), the upper piece (2-1) is exposed beyond the opening of the interlayer (1-1), the lower piece (2-2) is made of elastic material, and the back belt (3) is connected via the upper piece (2-1) to the fixed laminate (2).

The bottom of the upper piece (2-1) is connected via a second limit belt (8) to the bottom of the interlayer (1-1), and the second limit belt (8) is longer than the longitudinal length of the lower piece (2-2) to limit upward and downward movement of the upper piece (2-1).

The massage apparatus comprises at least one massage mechanism and a control circuit (4) used to control the massage mechanism. The control circuit (4) is also equipped with the power cable used to supply power for the control circuit (4) and the massage mechanism.

The massage apparatus also includes a first power supply (5). Both the control circuit (4) and the first power supply (5) are provided on the pack body (1), and the first power supply (5) feeds the control circuit (4) and the massage mechanism respectively.

The massage mechanism includes at least a first massage head (6). The first massage head (6) is fixed at the top of the fixed laminate (2) corresponding to the back.

The massage mechanism includes at least a second massage head (7). The second massage head (7) is fixed at the back bottom of the pack body (1) corresponding to the waist.

The massage mechanism includes at least a third massage head (9). The third massage head (9) is fixed at one end of the back belt (3) close to the fixed laminate (2) corresponding to the shoulder when the back belt (3) is used.

The control circuit (4) comprises a control panel (4-1) and a control circuit board (4-2) used to receive the instructions from the control panel (4-1) and control operation of the massage mechanism according to the instructions. The control circuit board (4-2) is disposed in the pack body (1). The control panel (4-1) mounted at any position of the backpack is connected via power cable to the control circuit board (4-2).

The pack body (1) comprises a backpack (1-3) and a waist belt (1-2) connected at the bottom left and right of the backpack (1-3) corresponding to the waist. The waist belts (1-2) can jointly fix the backpack at the waist. The pack body (1) comprises the front pocket body (11) and the back (12). The front pocket body (11) is integrated via a connector (10) with the back (12). Both the interlayer (1-1) and the fixed laminate (2) are disposed on the back (12). The front pocket body (11) is one of front pocket body structures of different styles and purposes.

The control panel (4-1) is disposed on the waist belt (1-2) connected at the bottom left and right of the pack body (1) corresponding to the waist. The waist belt is made of elastic stretchable material.

A second storage pocket (16) is disposed at the outer side wall of the pack body to place the first power supply (5). An opening (16-1) is arranged in the second storage pocket (16) to expose the switch button of the first power supply (5). The load-reducing massage backpack also includes an air inflation layer (17) or a water filling layer (19) arranged behind the fixed laminate (2). The air inflation layer (17) or a water filling layer (19) can press the fixed laminate (2) against the back after inflation or filling.

Figure 6:
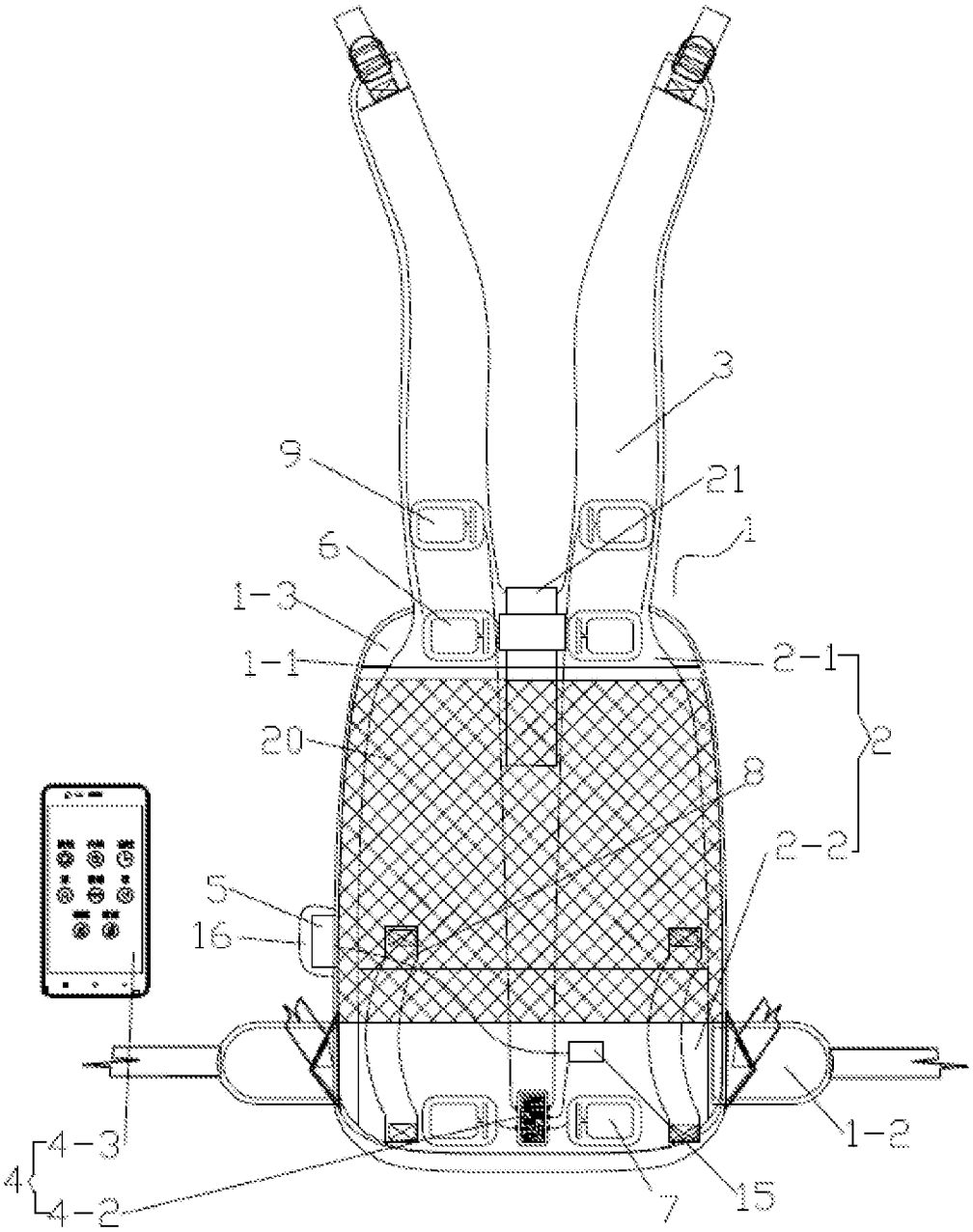
FIG. 6 is a structural view of unlocked back belt for embodiment 2 of load-reducing massage backpack according to the present invention.
Figure 7:
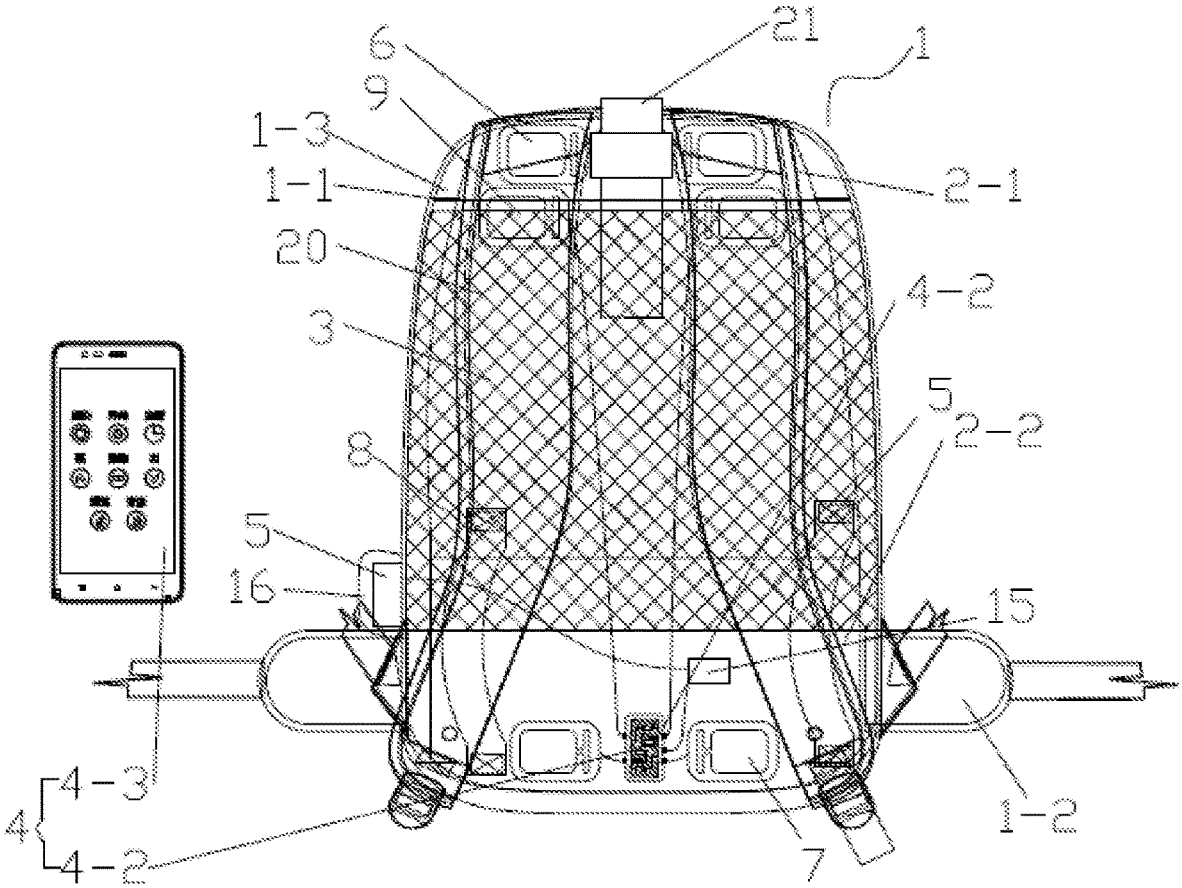
FIG. 7 is a structural view of a usage state for embodiment 2 of load-reducing massage backpack according to the present invention.

The load-reducing massage backpack may also integrates a heater or cooler. Embodiment 2. As shown in FIG. 6-FIG. 7, the embodiment differs from embodiment 1 in that: The control circuit (4) comprises a wireless remote controller (4-3) and a control circuit board (4-2) used to receive the instructions from the wireless remote controller (4-3) and control operation of the massage mechanism according to the instructions. The control circuit board (4-2) is disposed in the pack body (1). The wireless remote controller (4-3) is connected via radio signal to the control circuit board (4-2). The wireless remote controller (4-3) is a mobile terminal with control software.

Figure 8:
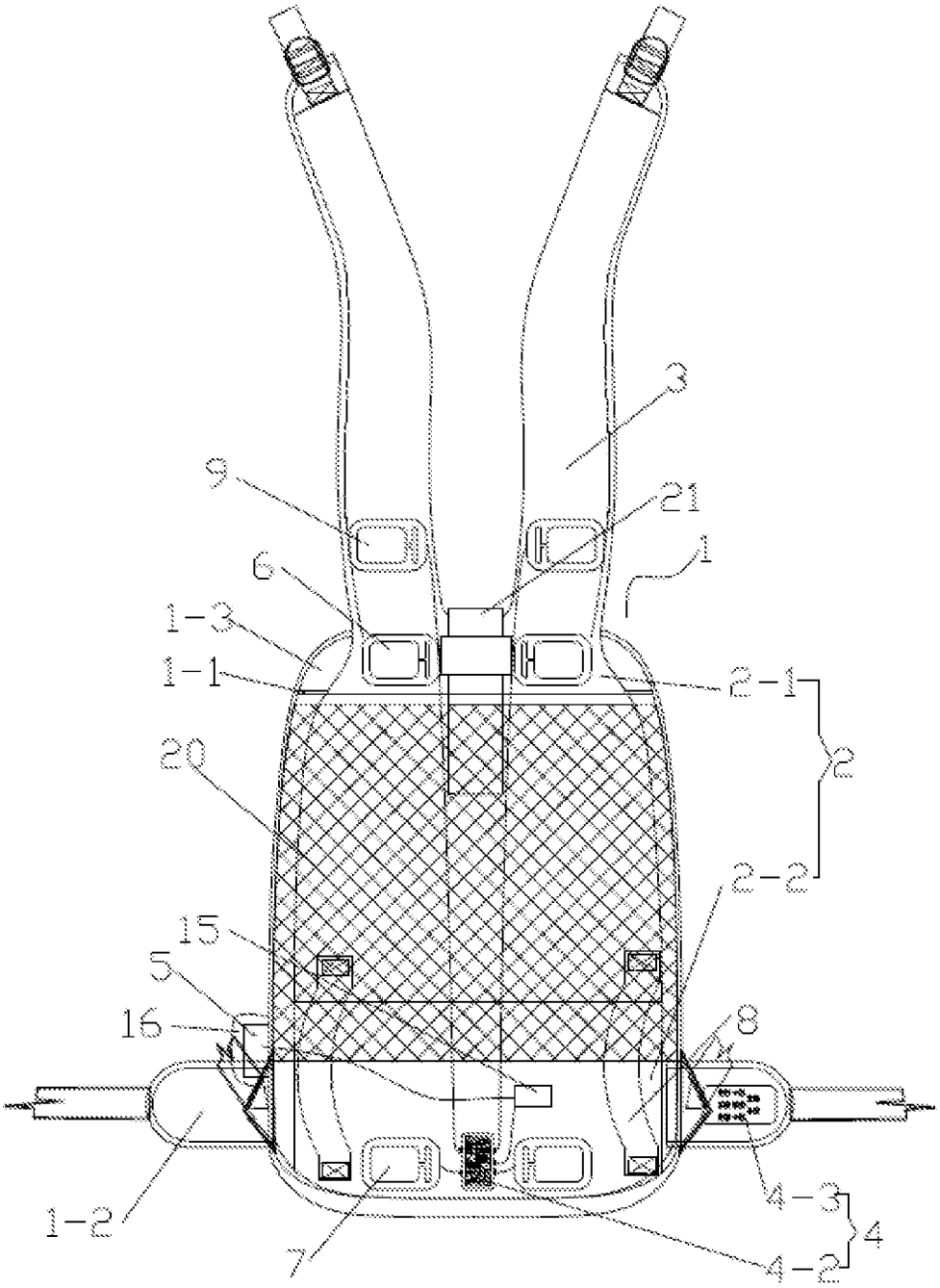
FIG. 8 is a structural view of unlocked back belt for embodiment 3 of load-reducing massage backpack according to the present invention.
Figure 9:
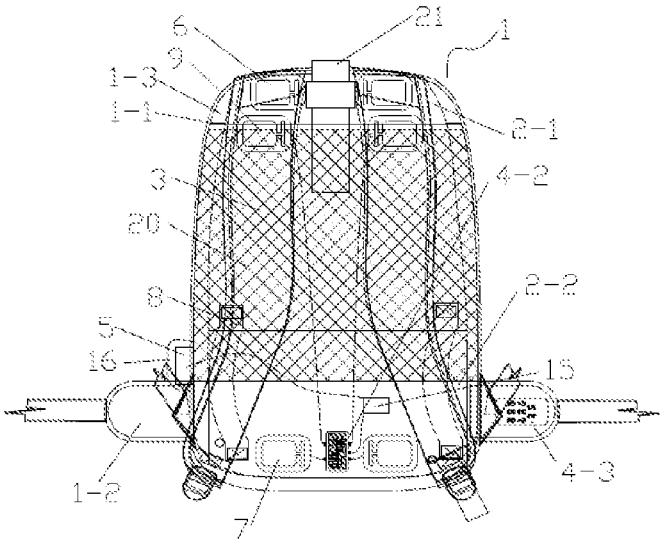
FIG. 9 is a structural view of a usage state for embodiment 3 of load-reducing massage backpack according to the present invention.

Embodiment 3. As shown in FIG. 8-FIG. 9, the embodiment differs from embodiment 1 in that: The control circuit (4) comprises a wireless remote controller (4-3) and a control circuit board (4-2) used to receive the instructions from the wireless remote controller (4-3) and control operation of the massage mechanism according to the instructions. The control circuit board (4-2) is disposed in the pack body (1). The wireless remote controller (4-3) is connected via radio signal to the control circuit board (4-2).

The wireless remote controller (4-3) is an infrared or a Bluetooth remote controller. The wireless remote controller (4-3) is disposed on the waist belt (1-2) connected at the bottom left and right of the pack body (1) corresponding to the waist.

Figure 10:
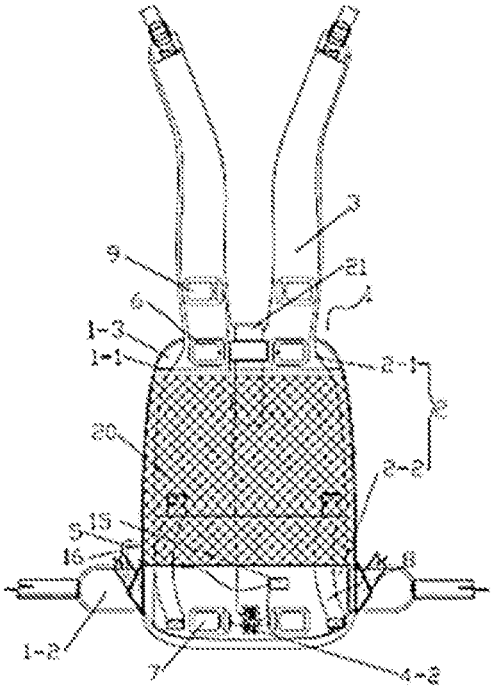
FIG. 10 is a structural view of unlocked back belt for embodiment 4 of load-reducing massage backpack according to the present invention.
Figure 11:
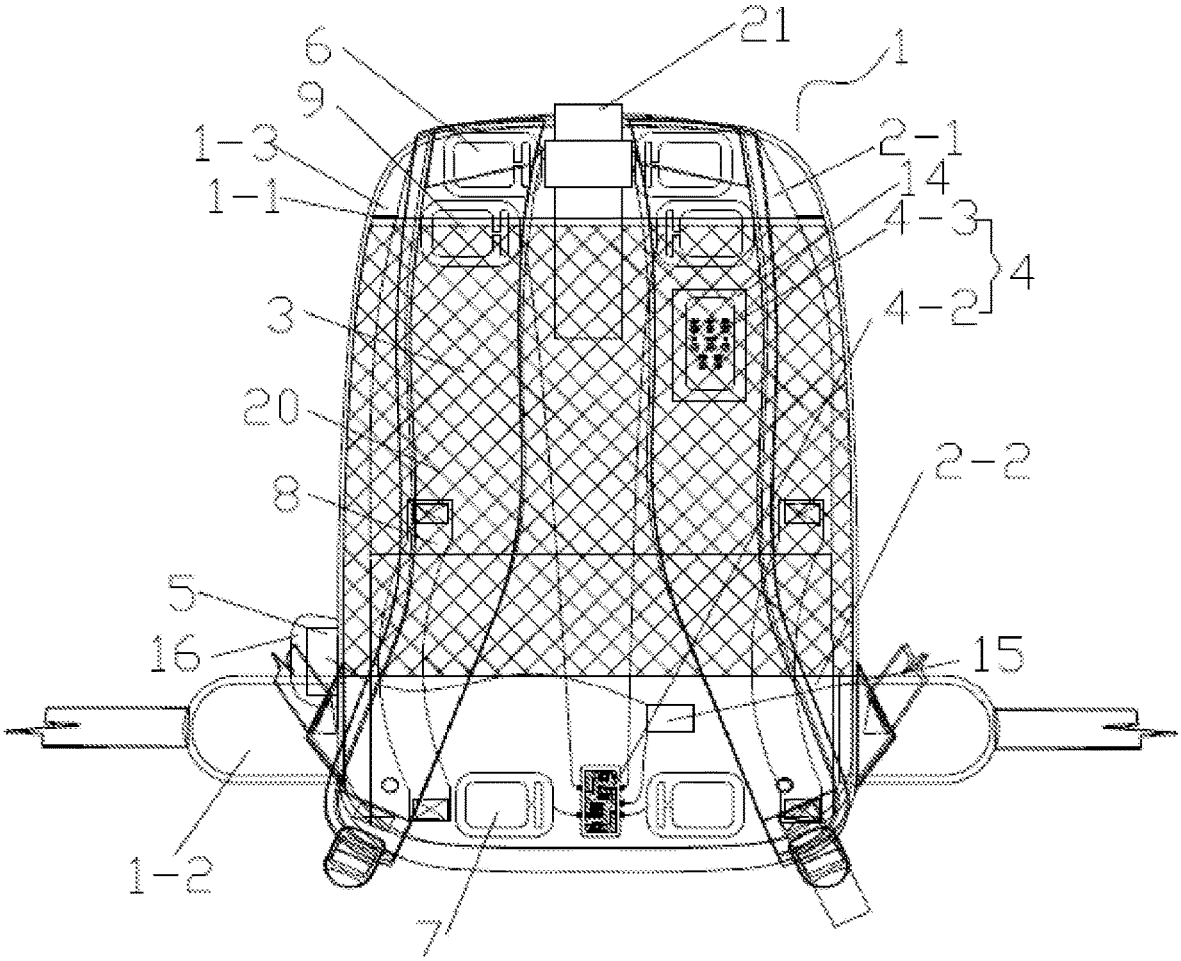
FIG. 11 is a structural view of a usage state for embodiment 4 of load-reducing massage backpack according to the present invention.

Embodiment 4. As shown in FIG. 10-FIG. 11, the embodiment differs from embodiment 1 in that: The control circuit (4) comprises a wireless remote controller (4-3) and a control circuit board (4-2) used to receive the instructions from the wireless remote controller (4-3) and control operation of the massage mechanism according to the instructions. The control circuit board (4-2) is disposed in the pack body (1). The wireless remote controller (4-3) is connected via radio signal to the control circuit board (4-2).

The wireless remote controller (4-3) is an infrared or a Bluetooth remote controller. A first storage pocket (14) is disposed on the back belt to place the control panel (4-1). The opening of the first storage pocket (14) can be opened or closed with a zipper or buckle. The control panel (4-1) is connected to the control circuit board (4-2) in the pack body (1) by passing through the first storage pocket (14).

Figure 12:
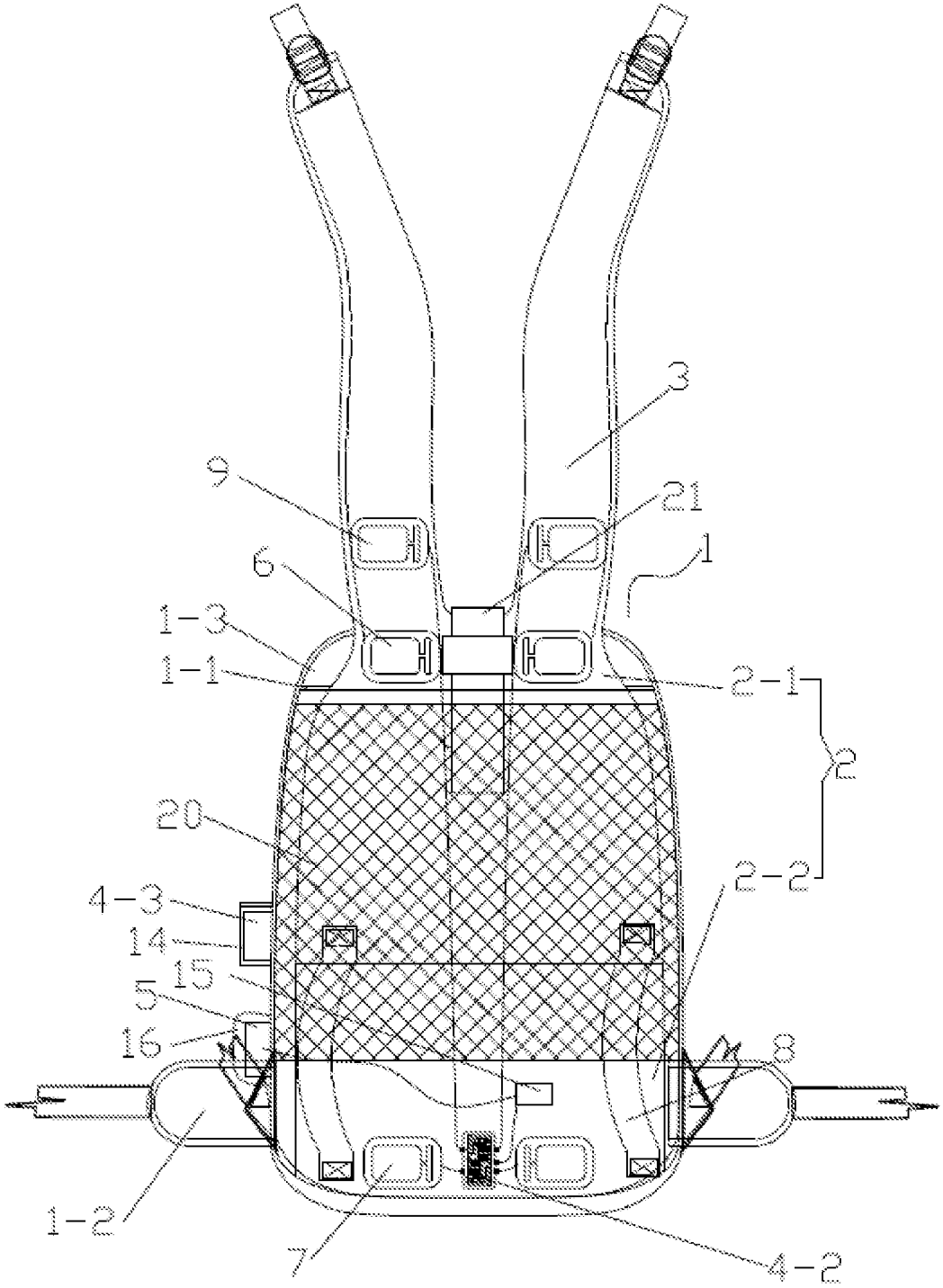
FIG. 12 is a structural view of unlocked back belt for embodiment 5 of load-reducing massage backpack according to the present invention.
Figure 13:
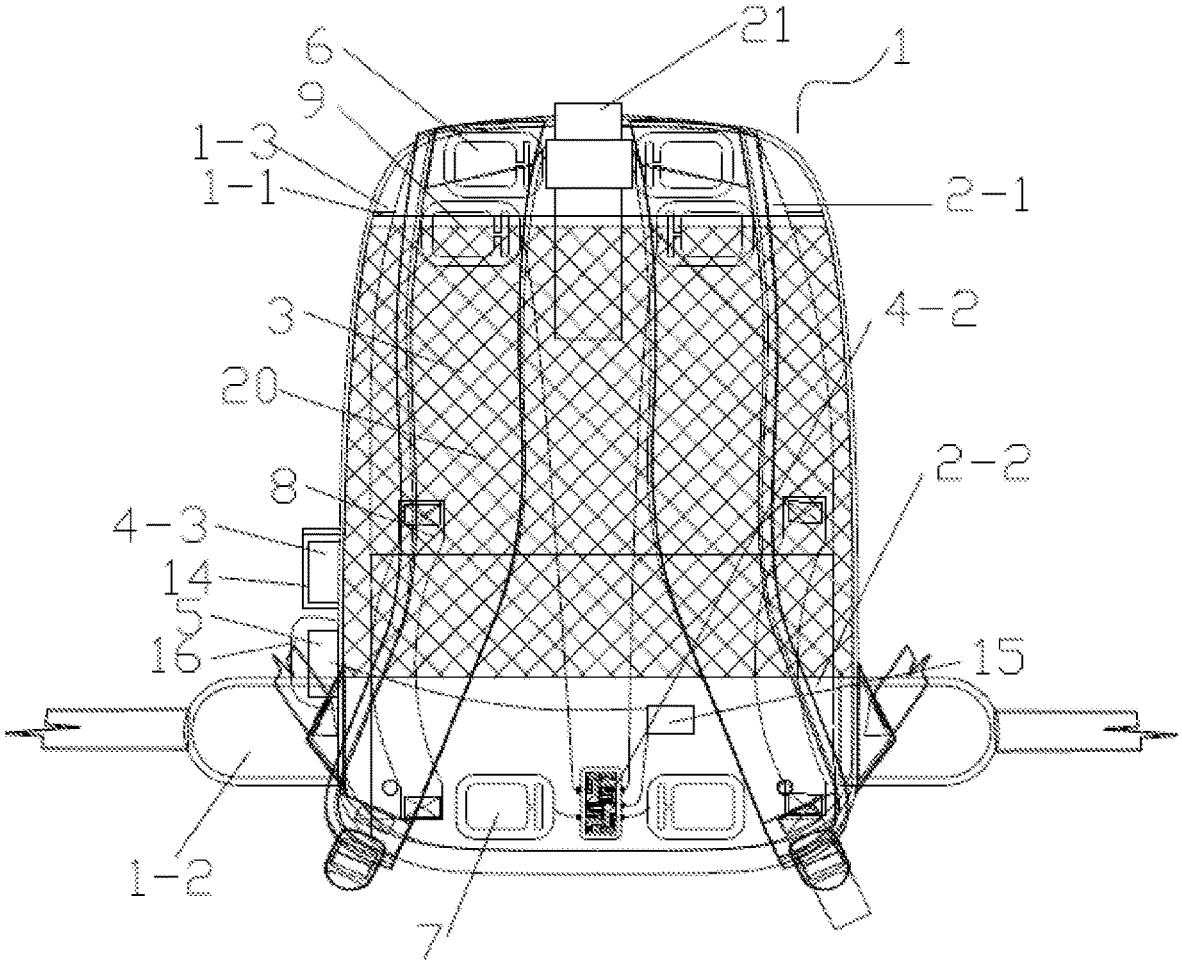
FIG. 13 is a structural view of a usage state for embodiment 5 of load-reducing massage backpack according to the present invention.
Figure 14:
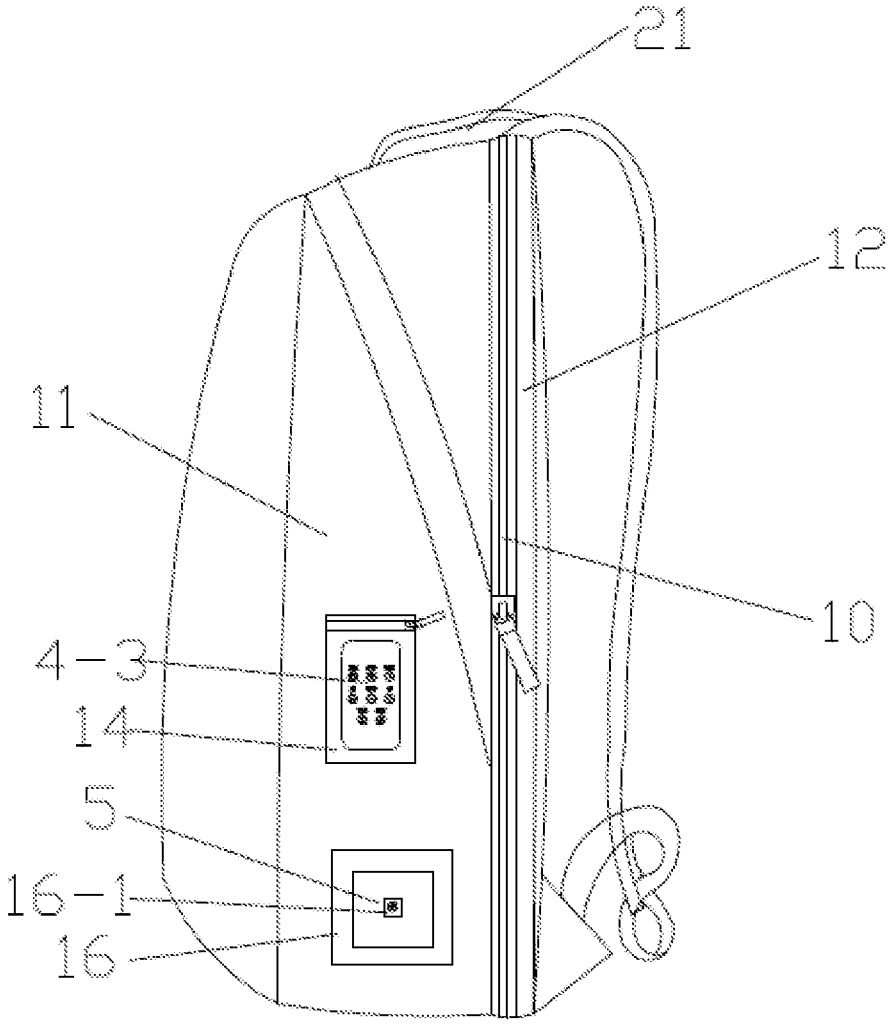
FIG. 14 is a side view for embodiment 5 of load-reducing massage backpack according to the present invention.

Embodiment 5. As shown in FIG. 12-FIG. 14, the embodiment differs from embodiment 1 in that: The control circuit (4) comprises a wireless remote controller (4-3) and a control circuit board (4-2) used to receive the instructions from the wireless remote controller (4-3) and control operation of the massage mechanism according to the instructions. The control circuit board (4-2) is disposed in the pack body (1). The wireless remote controller (4-3) is connected via radio signal to the control circuit board (4-2).

The wireless remote controller (4-3) is an infrared or a Bluetooth remote controller. A first storage pocket (14) is disposed on the pack body to place the control panel (4-1). The opening of the first storage pocket (14) can be opened or closed with a zipper or buckle. The control panel (4-1) is connected to the control circuit board (4-2) in the pack body (1) by passing through the first storage pocket (14).

Figure 15:
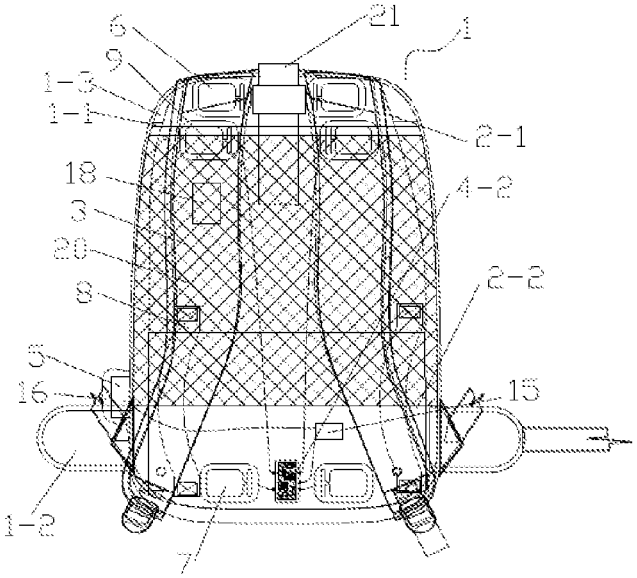
FIG. 15 is a structural view of a usage state for embodiment 6 of load-reducing massage backpack according to the present invention.

Embodiment 6. As shown in FIG. 15, the embodiment differs from embodiment 1 in that: A Bluetooth controller (18) with a charge interface is disposed on the back belt. The control circuit (4) comprises the Bluetooth controller (18) and the control circuit board (4-2) used to receive the instructions from the Bluetooth controller (18) and control operation of the massage mechanism according to the instructions. The Bluetooth controller (18) can receive Bluetooth signal and communicate with the mobile terminal with control software.

Figure 16:
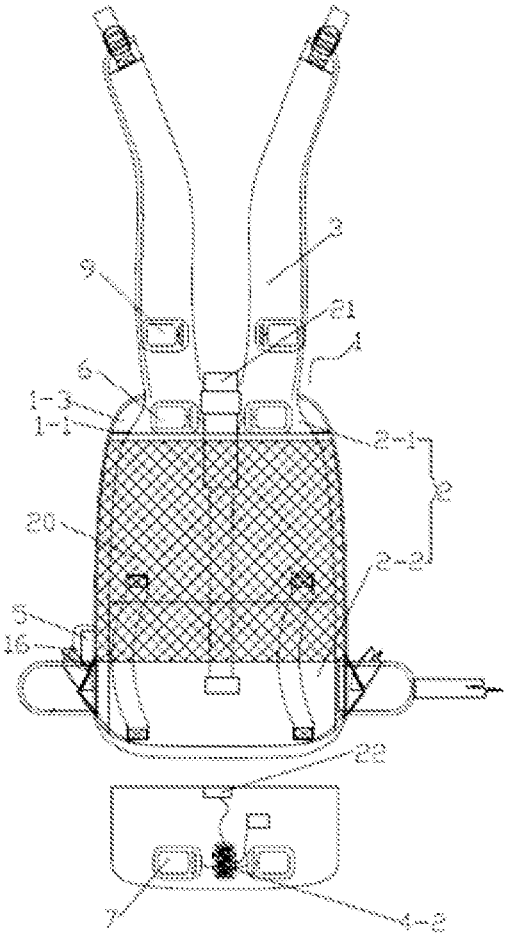
FIG. 16 is a structural view 1 of unlocked back belt for embodiment 7 of load-reducing massage backpack according to the present invention.
Figure 17:
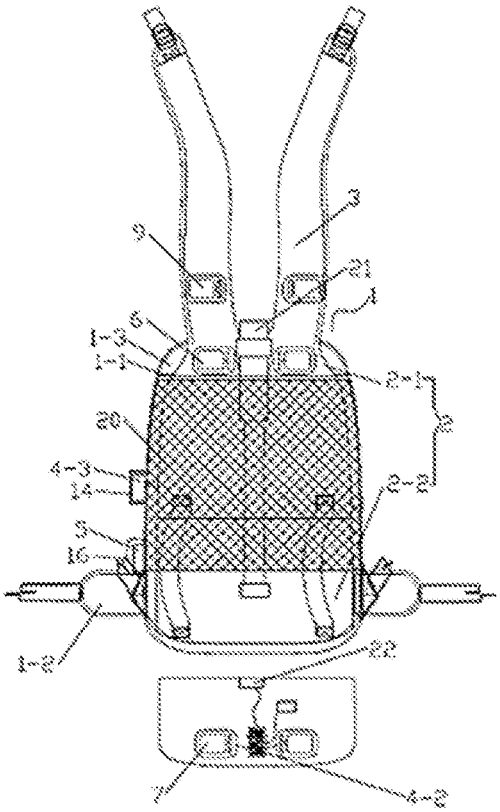
FIG. 17 is a structural view 2 of unlocked back belt for embodiment 7 of load-reducing massage backpack according to the present invention.

Embodiment 7. As shown in FIG. 16-FIG. 17, the embodiment differs from embodiment 1 in that: The removable massage apparatus disposed at the back of pack body (1) corresponding to the waist or disposed on the fixed laminate (2) corresponding to the back can be mounted on the pack body (1). The removable massage apparatus comprises a control circuit (4), a massage mechanism and a second power supply (15) electrically connected to the massage mechanism. The second power supply (15) feeds the massage mechanism and the control circuit (4) and can be dry battery or accumulator.

The removable massage apparatus also includes an interface (22) that can be connected to the first power supply (5). When the removable massage apparatus is mounted on the pack body, the first power supply (5) can supply power via the interface (22) to the massage mechanism and the control circuit (4).

Figure 18:
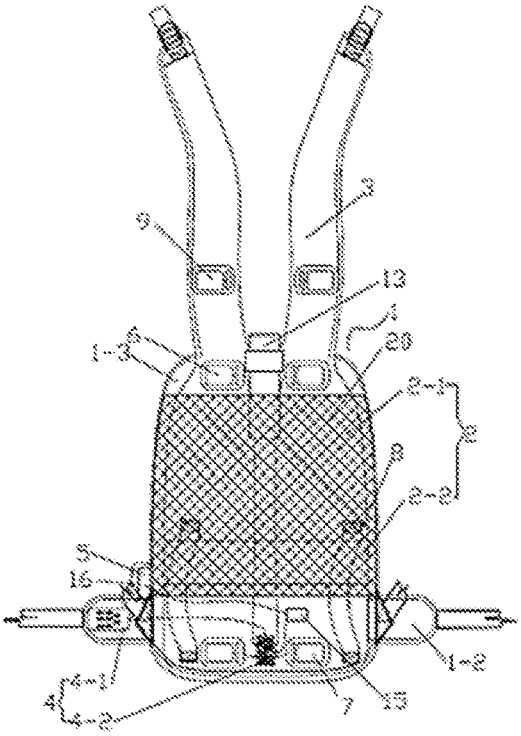
FIG. 18 is a structural view of unlocked back belt for embodiment 8 of load-reducing massage backpack according to the present invention.
Figure 19:
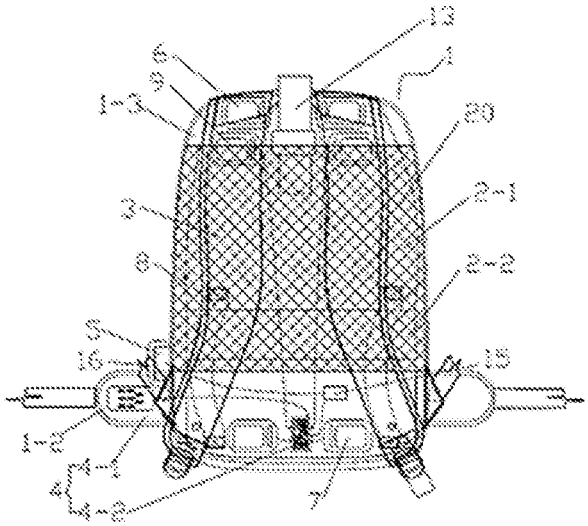
FIG. 19 is a structural view of a usage state for embodiment 8 of load-reducing massage backpack according to the present invention.

Embodiment 8. As shown in FIG. 18-FIG. 19, the present invention relates to a load-reducing massage backpack which differs from embodiment 1 in that: The load-reducing massage backpack comprises the pack body (1) and the back belt (3), wherein an elastic fixed laminate (2) is disposed at the back of the pack body (1), the lower end of the fixed laminate (2) is fixed at the back bottom of the pack body (1) and the upper end is fixed and connected to the back belt (3), the top of the fixed laminate (2) is connected via a third limit belt (13) to the top of the pack body (1), and a massage apparatus is arranged at one or more positions where the back of the pack body (1) is against the waist, the fixed laminate (2) is against the back or the back belt (3) is against the shoulder.

The load-reducing massage backpack also includes an isolation layer (20) of which two side edges are connected to two side edges of the back of the pack body (1). The isolation layer (20) is disposed at part or all of external surface of the fixed laminate (2) and can press the fixed laminate (2) more closely against the back of the pack body (1).

Figure 20:
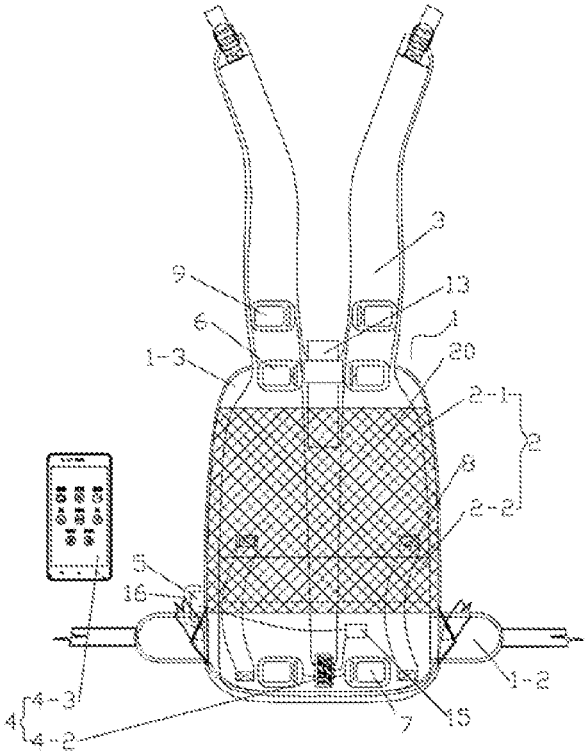
FIG. 20 is a structural view of unlocked back belt for embodiment 9 of load-reducing massage backpack according to the present invention.
Figure 21:
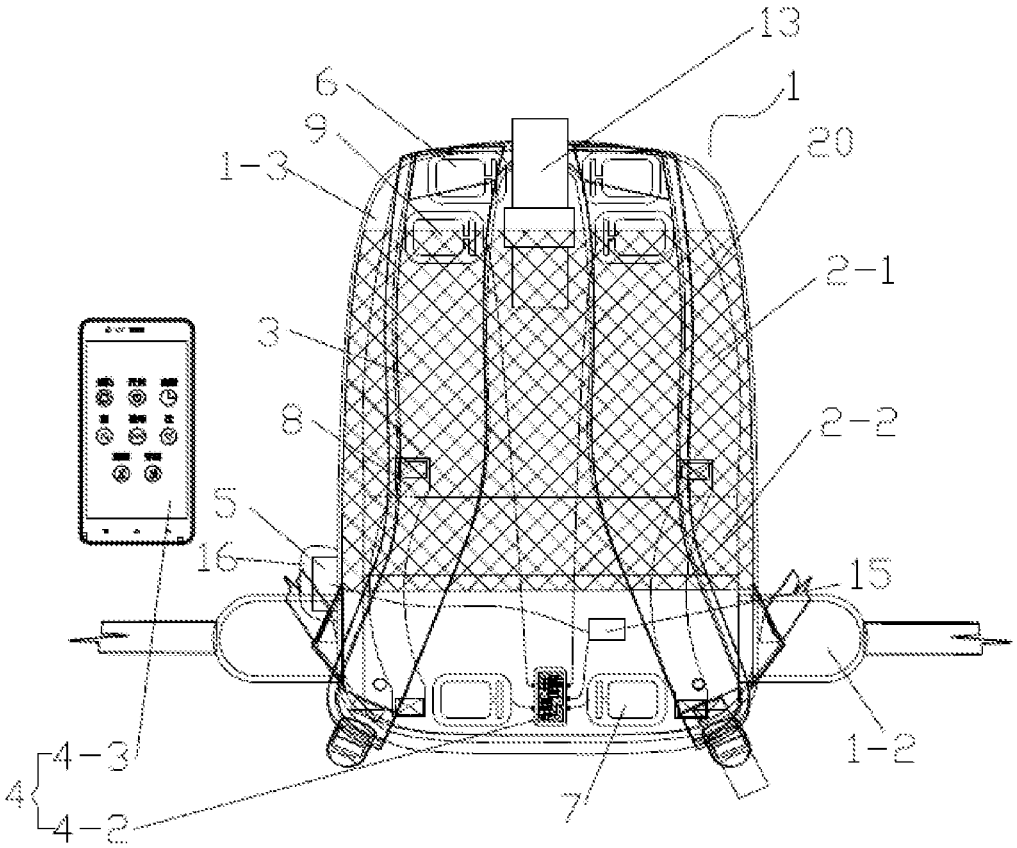
FIG. 21 is a structural view of a usage state for embodiment 9 of load-reducing massage backpack according to the present invention.

Embodiment 9. As shown in FIG. 20-FIG. 21, the embodiment differs from embodiment 2 in that: The load-reducing massage backpack comprises the pack body (1) and the back belt (3), wherein an elastic fixed laminate (2) is disposed at the back of the pack body (1), the lower end of the fixed laminate (2) is fixed at the back of the pack body (1) and the upper end is fixed and connected to the back belt (3), the top of the fixed laminate (2) is connected via a third limit belt (13) to the top of the pack body (1), and a massage apparatus is arranged at one or more positions where the back of the pack body (1) is against the waist, the fixed laminate (2) is against the back or the back belt (3) is against the shoulder.

The load-reducing massage backpack also includes an isolation layer (20) of which two side edges are connected to two side edges of the back of the pack body (1). The isolation layer (20) is disposed at part or all of external surface of the fixed laminate (2) and can press the fixed laminate (2) more closely against the back of the pack body (1).

Figure 22:
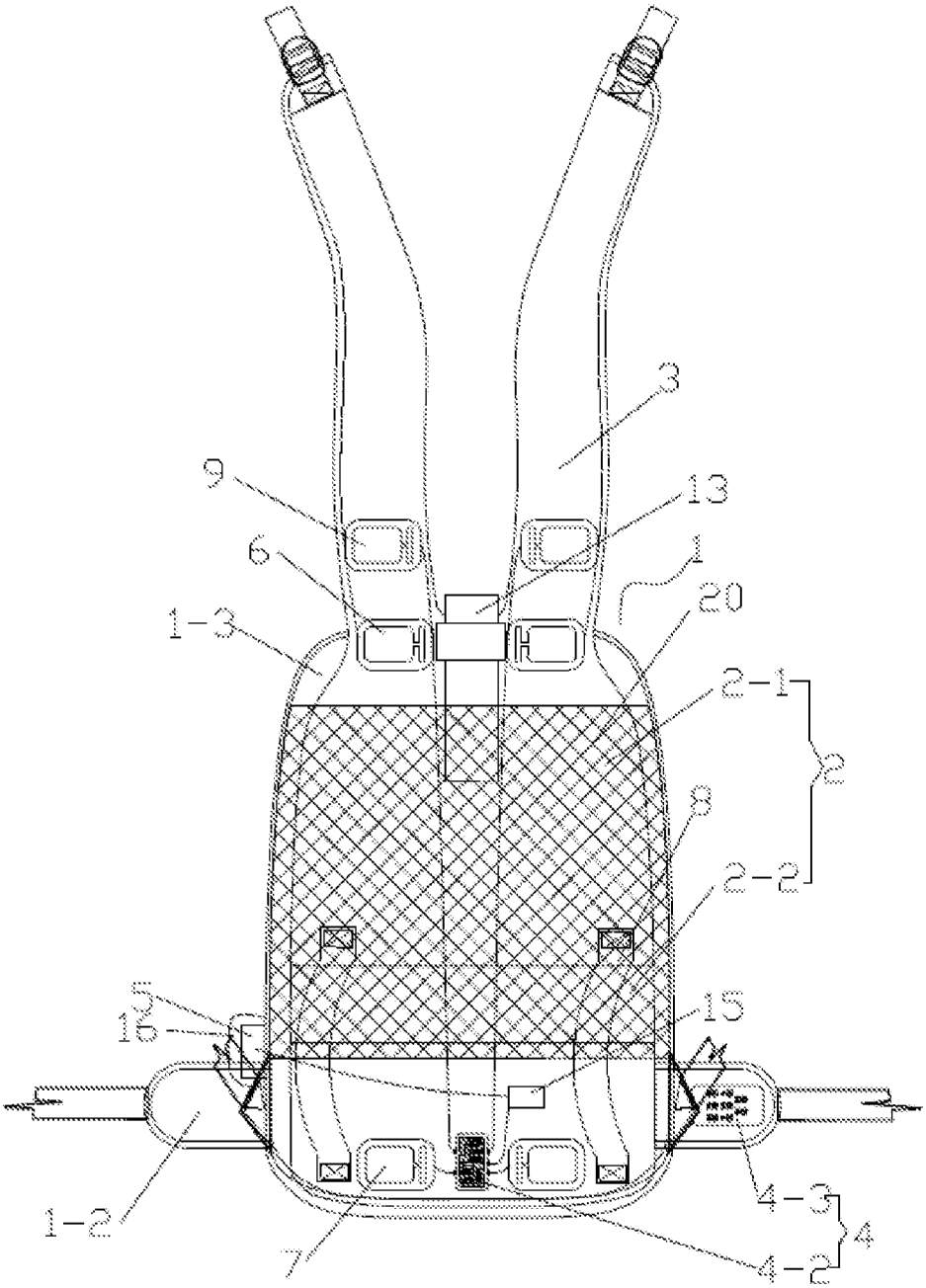
FIG. 22 is a structural view of unlocked back belt for embodiment 10 of load-reducing massage backpack according to the present invention.
Figure 23:
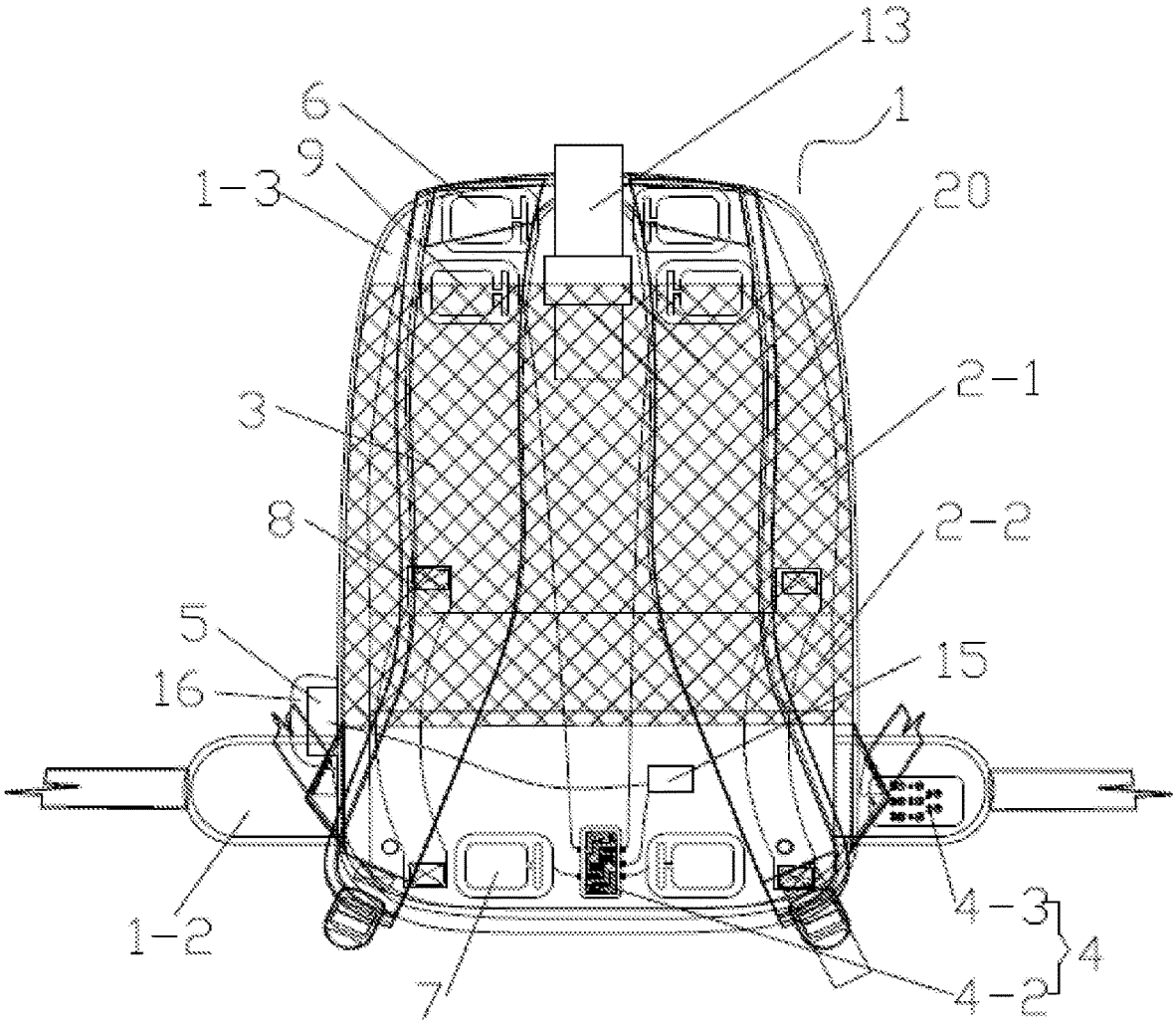
FIG. 23 is a structural view of a usage state for embodiment 10 of load-reducing massage backpack according to the present invention.

Embodiment 10. As shown in FIG. 22-FIG. 23, the embodiment differs from embodiment 3 in that: The load-reducing massage backpack comprises the pack body (1) and the back belt (3), wherein an elastic fixed laminate (2) is disposed at the back of the pack body (1), the lower end of the fixed laminate (2) is fixed at the back of the pack body (1) and the upper end is fixed and connected to the back belt (3), the top of the fixed laminate (2) is connected via a third limit belt (13) to the top of the pack body (1), and a massage apparatus is arranged at one or more positions where the back of the pack body (1) is against the waist, the fixed laminate (2) is against the back or the back belt (3) is against the shoulder.

The load-reducing massage backpack also includes an isolation layer (20) of which two side edges are connected to two side edges of the back of the pack body (1). The isolation layer (20) is disposed at part or all of external surface of the fixed laminate (2) and can press the fixed laminate (2) more closely against the back of the pack body (1).

Figure 24:
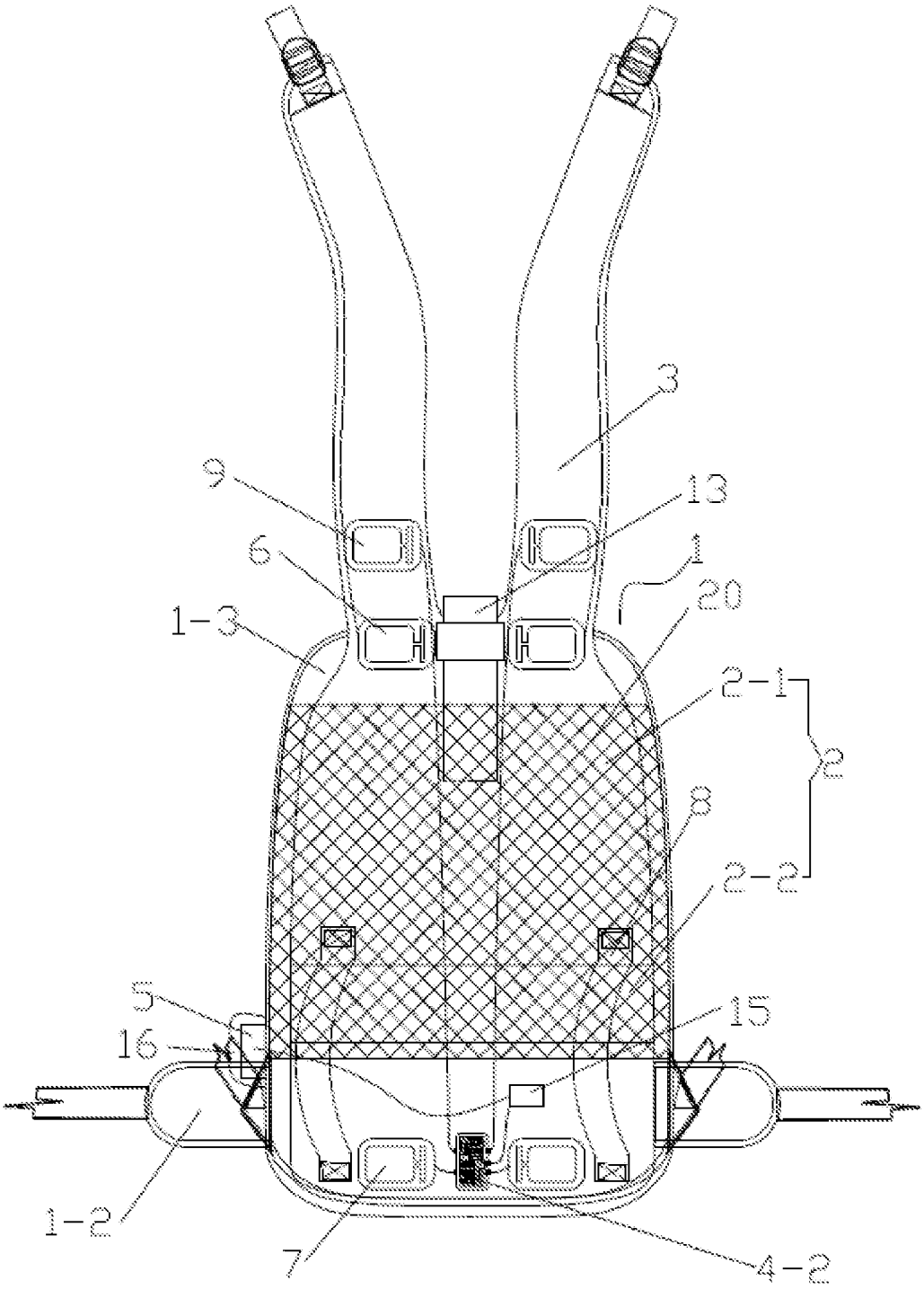
FIG. 24 is a structural view of unlocked back belt for embodiment 11 of load-reducing massage backpack according to the present invention.
Figure 25:
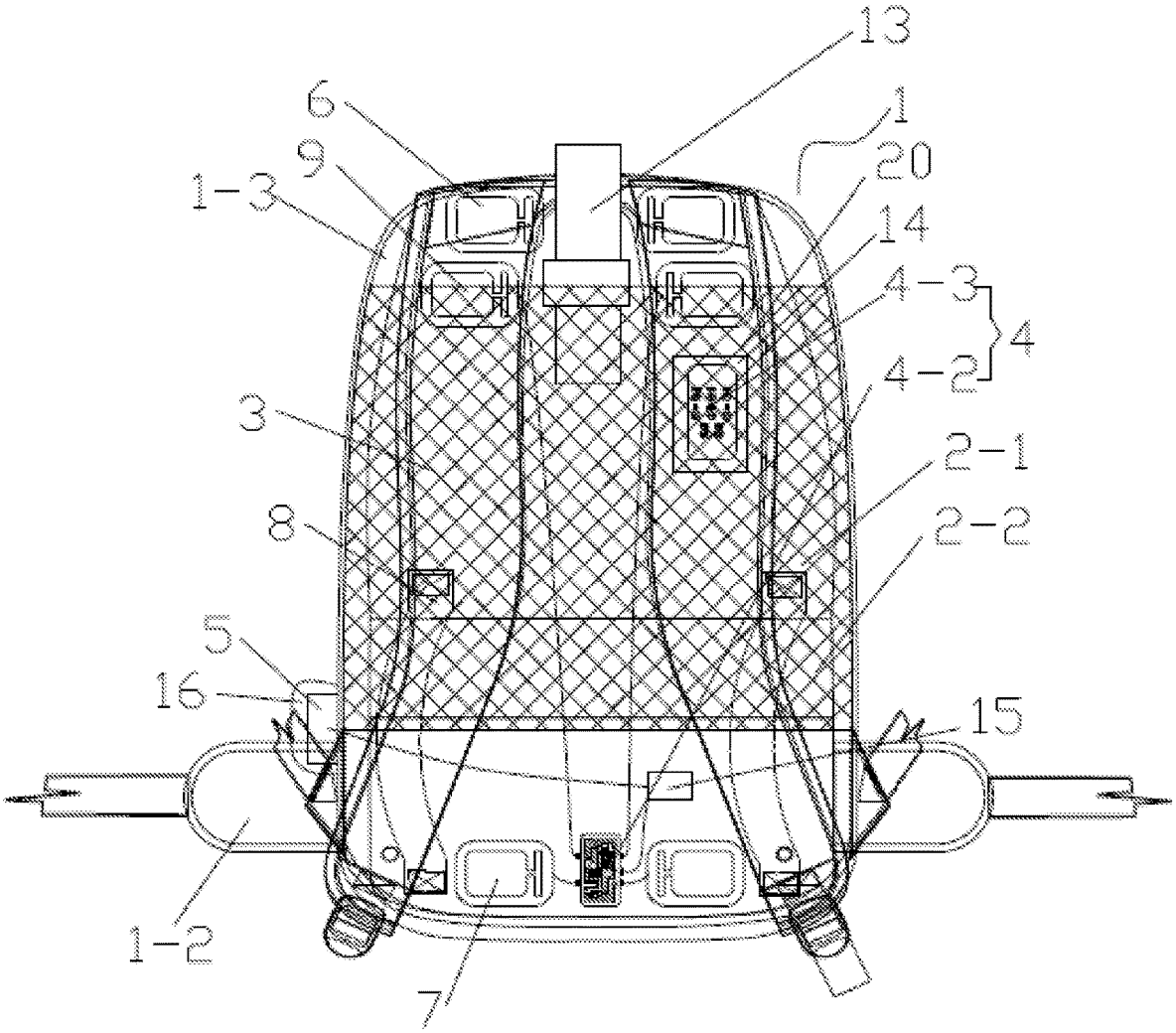
FIG. 25 is a structural view of a usage state for embodiment 11 of load-reducing massage backpack according to the present invention.

Embodiment 11. As shown in FIG. 24-FIG. 25, the embodiment differs from embodiment 4 in that: The load-reducing massage backpack comprises the pack body (1) and the back belt (3), wherein an elastic fixed laminate (2) is disposed at the back of the pack body (1), the lower end of the fixed laminate (2) is fixed at the back of the pack body (1) and the upper end is fixed and connected to the back belt (3), the top of the fixed laminate (2) is connected via a third limit belt (13) to the top of the pack body (1), and a massage apparatus is arranged at one or more positions where the back of the pack body (1) is against the waist, the fixed laminate (2) is against the back or the back belt (3) is against the shoulder.

The load-reducing massage backpack also includes an isolation layer (20) of which two side edges are connected to two side edges of the back of the pack body (1). The isolation layer (20) is disposed at part or all of external surface of the fixed laminate (2) and can press the fixed laminate (2) more closely against the back of the pack body (1).

Figure 26:
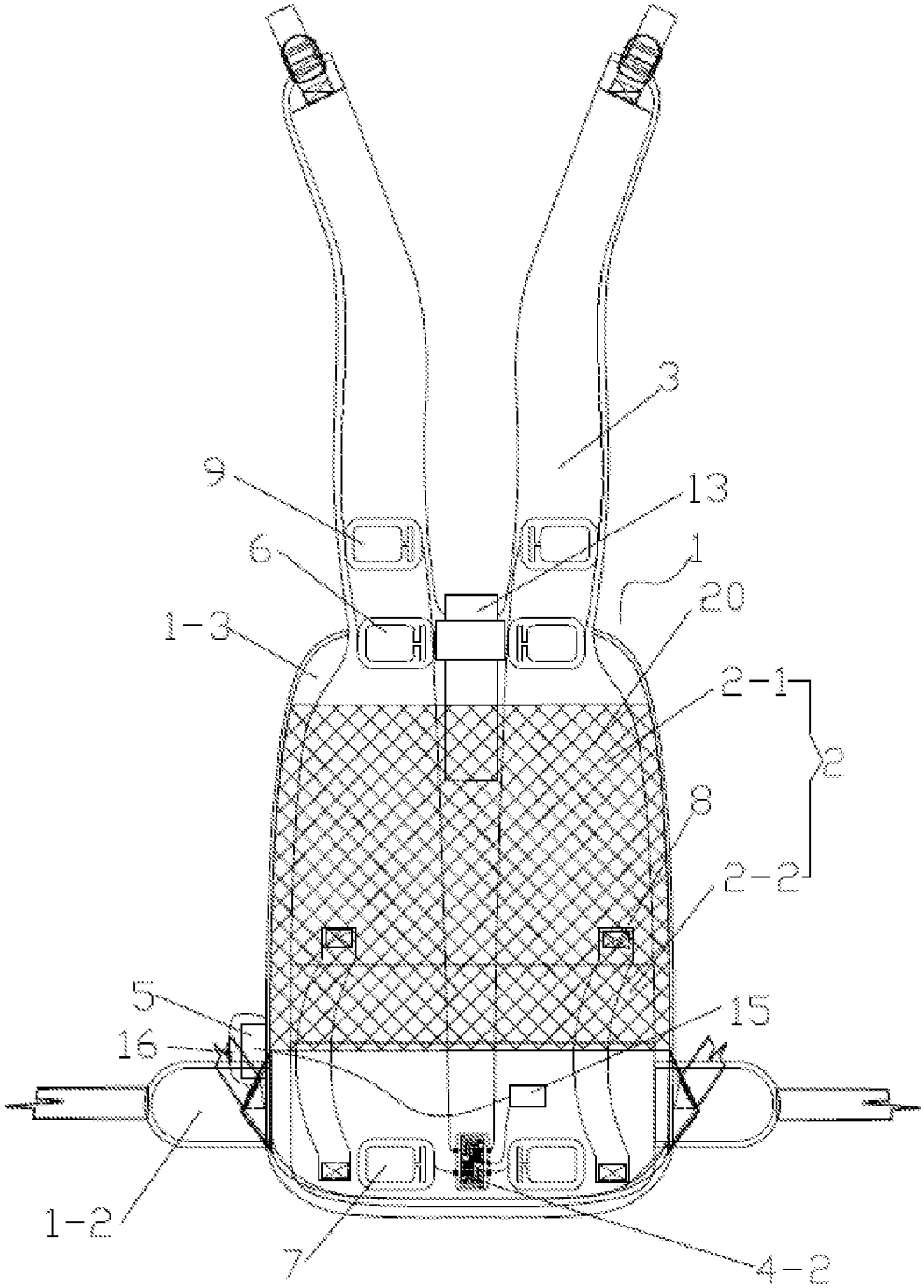
FIG. 26 is a structural view of unlocked back belt for embodiment 12 of load-reducing massage backpack according to the present invention.
Figure 27:
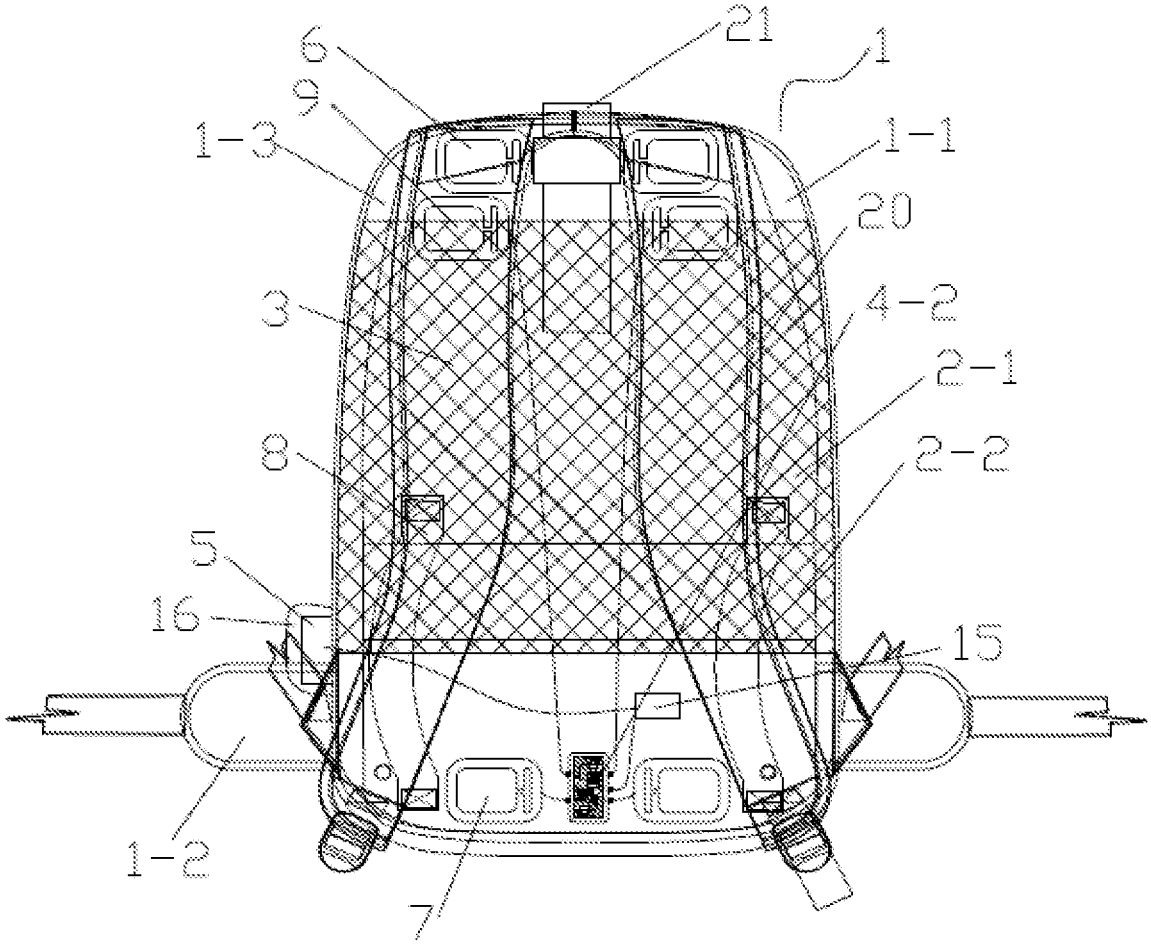
FIG. 27 is a structural view of a usage state for embodiment 12 of load-reducing massage backpack according to the present invention.
Figure 28:
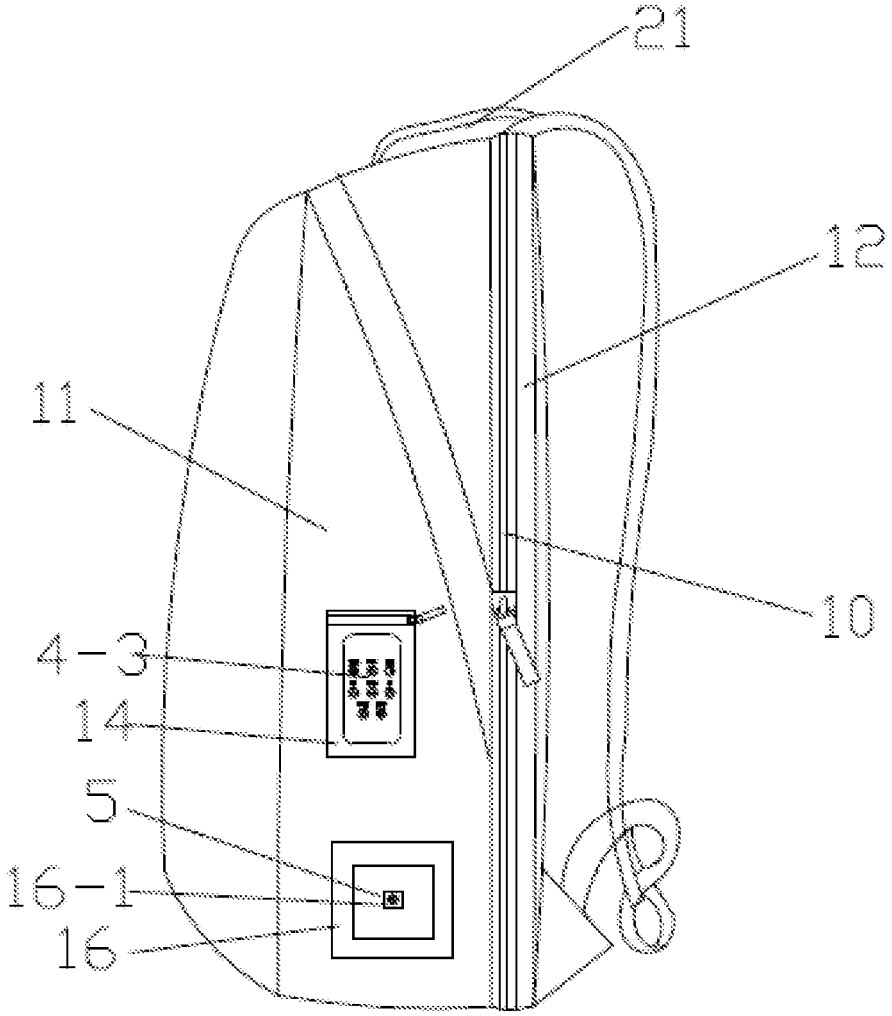
FIG. 28 is a side view for embodiment 12 of load-reducing massage backpack according to the present invention.

Embodiment 12. As shown in FIG. 26-FIG. 28, the embodiment differs from embodiment 5 in that: The load-reducing massage backpack comprises the pack body (1) and the back belt (3), wherein an elastic fixed laminate (2) is disposed at the back of the pack body (1), the lower end of the fixed laminate (2) is fixed at the back of the pack body (1) and the upper end is fixed and connected to the back belt (3), the top of the fixed laminate (2) is connected via a third limit belt (13) to the top of the pack body (1), and a massage apparatus is arranged at one or more positions where the back of the pack body (1) is against the waist, the fixed laminate (2) is against the back or the back belt (3) is against the shoulder.

The load-reducing massage backpack also includes an isolation layer (20) of which two side edges are connected to two side edges of the back of the pack body (1). The isolation layer (20) is disposed at part or all of external surface of the fixed laminate (2) and can press the fixed laminate (2) more closely against the back of the pack body (1).

Figure 29:
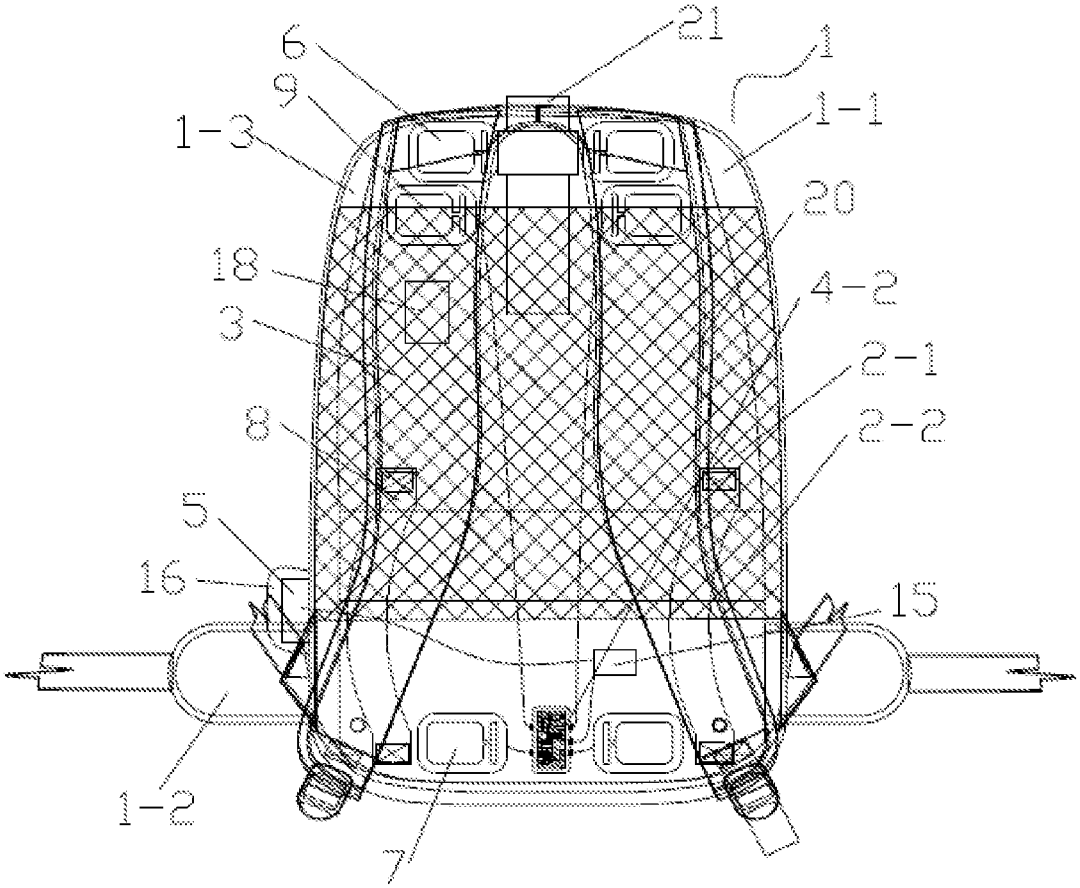
FIG. 29 is a structural view of a usage state for embodiment 13 of load-reducing massage backpack according to the present invention.

Embodiment 13. As shown in FIG. 29, the embodiment differs from embodiment 6 in that: The load-reducing massage backpack comprises the pack body (1) and the back belt (3), wherein an elastic fixed laminate (2) is disposed at the back of the pack body (1), the lower end of the fixed laminate (2) is fixed at the back bottom of the pack body (1) and the upper end is fixed and connected to the back belt (3), the top of the fixed laminate (2) is connected via a third limit belt (13) to the top of the pack body (1), and a massage apparatus is arranged at one or more positions where the back of the pack body (1) is against the waist, the fixed laminate (2) is against the back or the back belt (3) is against the shoulder.

The load-reducing massage backpack also includes an isolation layer (20) of which two side edges are connected to two side edges of the back of the pack body (1). The isolation layer (20) is disposed at part or all of external surface of the fixed laminate (2) and can press the fixed laminate (2) more closely against the back of the pack body (1).

Figure 30:
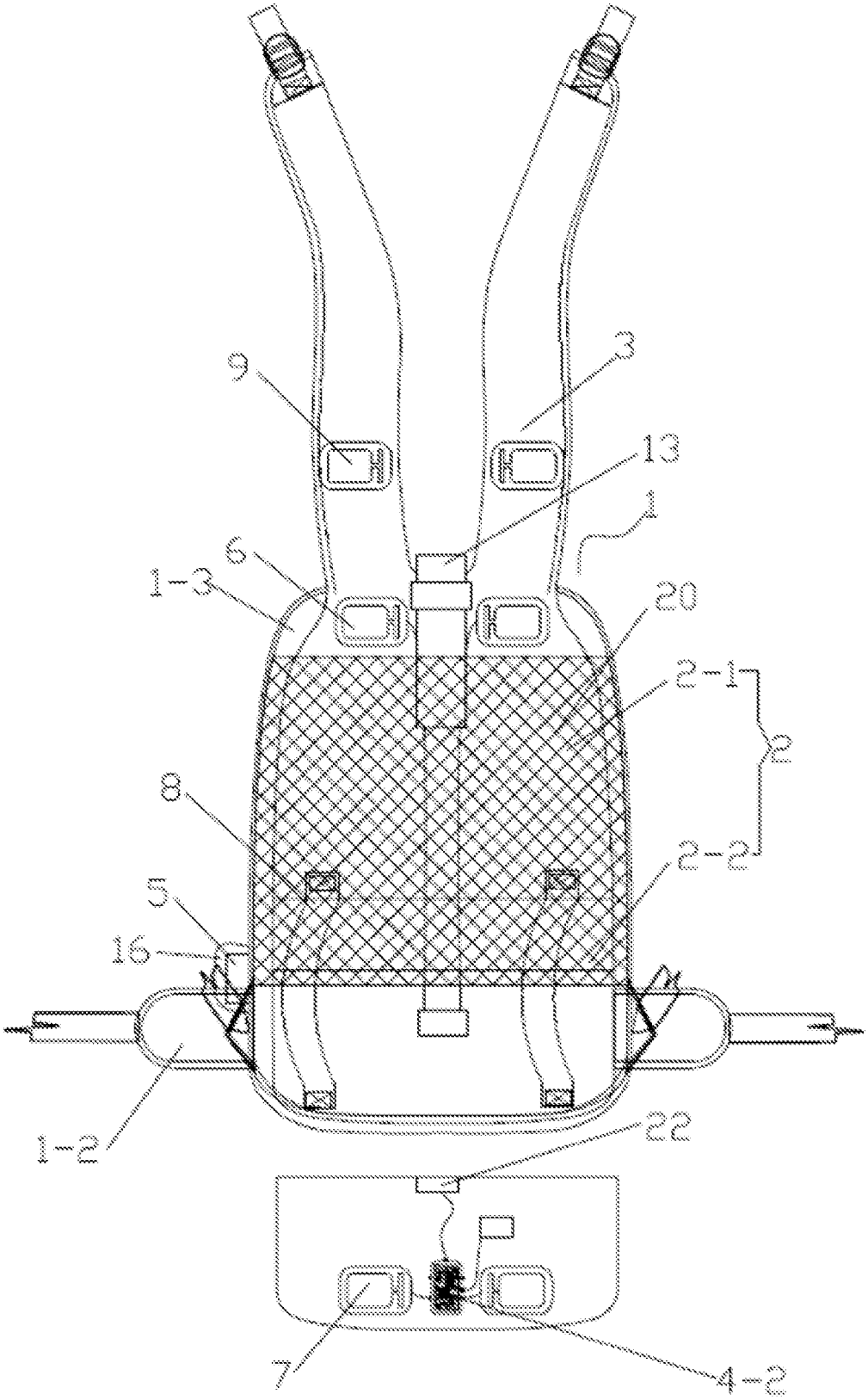
FIG. 30 is a structural view 1 of unlocked back belt for embodiment 14 of load-reducing massage backpack according to the present invention.
Figure 31:
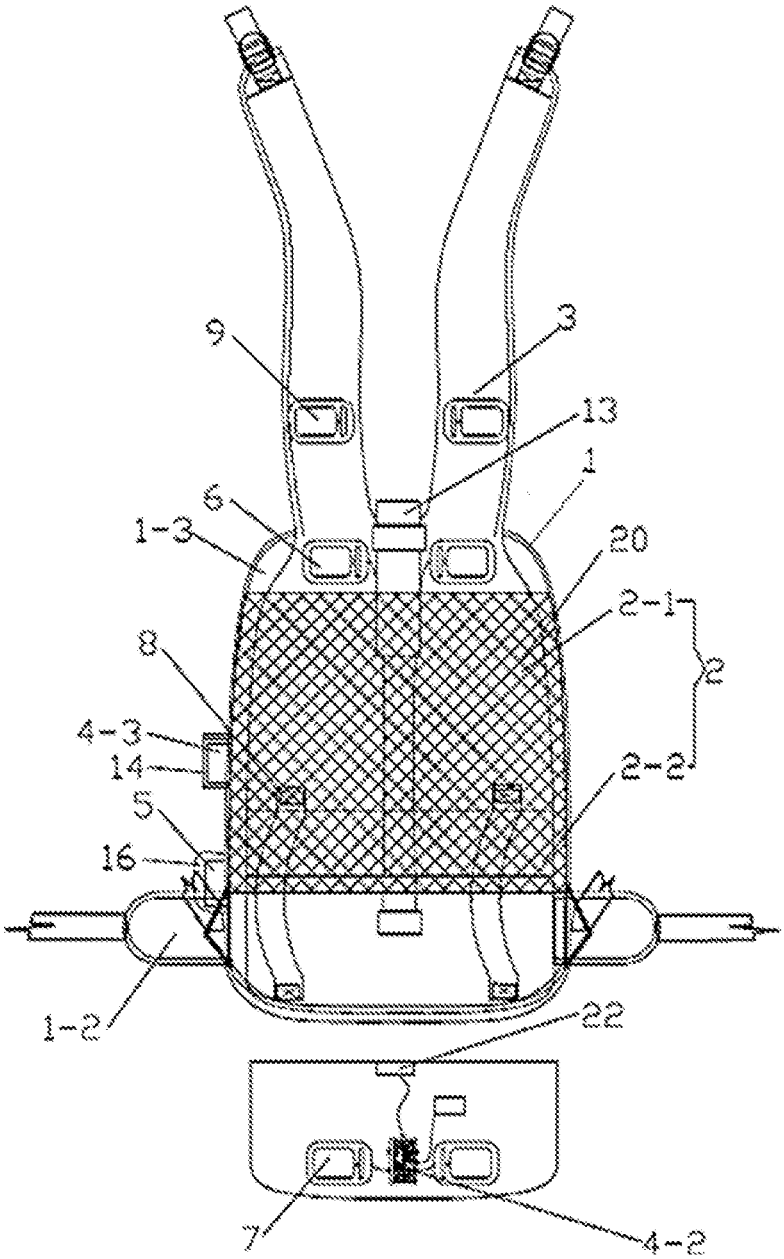
FIG. 31 is a structural view 2 of unlocked back belt for embodiment 14 of load-reducing massage backpack according to the present invention.

Embodiment 14. As shown in FIG. 30-FIG. 31, the embodiment differs from embodiment 7 in that: The load-reducing massage backpack comprises the pack body (1) and the back belt (3), wherein an elastic fixed laminate (2) is disposed at the back of the pack body (1), the lower end of the fixed laminate (2) is fixed at the back of the pack body (1) and the upper end is fixed and connected to the back belt (3), the top of the fixed laminate (2) is connected via a third limit belt (13) to the top of the pack body (1), and a massage apparatus is arranged at one or more positions where the back of the pack body (1) is against the waist, the fixed laminate (2) is against the back or the back belt (3) is against the shoulder.

The load-reducing massage backpack also includes an isolation layer (20) of which two side edges are connected to two side edges of the back of the pack body (1). The isolation layer (20) is disposed at part or all of external surface of the fixed laminate (2) and can press the fixed laminate (2) more closely against the back of the pack body (1).

The present invention is not limited to the above embodiments. Any improvement or substitution based on the principle of the present invention shall be within the scope of protection of the present invention.

The invention claimed is:

1. The utility model relates to a load-reducing massage backpack, comprising a pack body and a shoulder strap, an interlayer with an upper opening is arranged on the pack body against the back, an elastic fixed laminate is provided in the interlayer, a lower end of the elastic fixed laminate is provided at a bottom of the interlayer, an upper end extends out of the opening and is connected to the shoulder strap, and a massage apparatus is arranged at one or more positions where a back of the pack body is against the waist, the elastic fixed laminate is against the back or the shoulder strap is against the shoulder, wherein the elastic fixed laminate further includes an upper piece and a lower piece connected in sequence from top to down, a bottom of the lower piece is connected at the bottom of the interlayer, the upper piece is exposed beyond the opening of the interlayer, the lower piece is made of elastic material, and the shoulder strap is connected by the upper piece to the elastic fixed laminate, wherein the bottom of the upper piece is connected by the second limit belt to the bottom of the interlayer, and the second limit belt is longer than the longitudinal length of the lower piece to limit upward and downward movement of the upper piece.

2. A load-reducing massage backpack as claimed in claim 1, wherein a top of the elastic fixed laminate is also connected by a first limit belt to a top of the pack body.

3. A load-reducing massage backpack as claimed in claim 1, wherein the massage apparatus comprises at least one massage mechanism and a control circuit used to control the massage mechanism, and the control circuit is also equipped with the power cable used to supply power for the control circuit and the massage mechanism.

4. A load-reducing massage backpack as claimed in claim 3, wherein the massage apparatus also includes a first power supply, both the control circuit and the first power supply are provided on the pack body, and the first power supply feeds the control circuit and the massage mechanism respectively.

5. A load-reducing massage backpack as claimed in claim 3, wherein the massage mechanism includes at least a first massage head, and the first massage head is fixed at the top of the elastic fixed laminate corresponding to the back.

6. A load-reducing massage backpack as claimed in claim 3, wherein the massage mechanism includes at least a second massage head, and the second massage head is fixed at the back bottom of the pack body corresponding to the waist.

7. A load-reducing massage backpack as claimed in claim 3, wherein the massage mechanism includes at least a third massage head, and the third massage head is fixed at one end of the shoulder strap close to the elastic fixed laminate corresponding to the shoulder when the shoulder strap is used.

8. A load-reducing massage backpack as claimed in claim 3, wherein the control circuit comprises a control panel and a control circuit board used to receive the instructions from the control panel and control operation of the massage mechanism according to the instructions, the control circuit board is disposed in the pack body, and the control panel mounted at any position of the backpack is connected via power cable to the control circuit board.

* * * * *